US005680079A

United States Patent [19]

Inami et al.

[11] Patent Number: 5,680,079

[45] Date of Patent: Oct. 21, 1997

[54] 180-DEGREE PHASE SHIFTER

[75] Inventors: Kazuyoshi Inami; Michiaki Kasahara; Hazime Kawano; Kohichi Muroi, all of Kanagawa-ken, Japan

[73] Assignee: Mitsubishi Denki Kabushiki Kaisha, Tokyo, Japan

[21] Appl. No.: 449,076

[22] Filed: May 24, 1995

[30] Foreign Application Priority Data

May 24, 1994 [JP] Japan ..... 6-109539

[51] Int. Cl.[6] ..... H01P 1/18

[52] U.S. Cl. ..... 333/161; 333/164

[58] Field of Search ..... 333/101, 103, 333/104, 156, 161, 164; 327/29, 30; 307/127

[56] References Cited

U.S. PATENT DOCUMENTS

| | | | |
|---|---|---|---|
| 3,579,093 | 5/1971 | Johannessen | 327/461 X |
| 3,673,426 | 6/1972 | Weston et al. | 307/127 |
| 3,911,294 | 10/1975 | Davis et al. | 327/430 |
| 3,996,533 | 12/1976 | Lee | 333/103 |
| 4,400,637 | 8/1983 | Klar et al. | 307/497 |
| 5,053,731 | 10/1991 | Algiere et al. | 333/101 |
| 5,103,195 | 4/1992 | Dunsmore | 333/103 |
| 5,424,696 | 6/1995 | Nakahara et al. | 333/161 |
| 5,430,401 | 7/1995 | Shtulman | 327/434 |

FOREIGN PATENT DOCUMENTS 0039076 4/1981 European Pat. Off. .

OTHER PUBLICATIONS

Mikrowellen Magazin "Len Breitbandiger, Planarer 0°/180° Phasenschalter", vol. 13, No. 4, 1987 pp. 398–401.

Telecommunications and Radio Engineering "A π–Phase Shifter Based on Microwave Strip Wavguides", pp. 84–85 A. R. Tagilaev, 1992.

M. Aust, et al "GaAs Monolithic Components Development for Q–Band Phased Array Application" TRW Electronics and Technology Division —IEEE MTT Digest 1992, pp. 703–706.

V.E. Dunn, et al "Mmic Phase Shifters and Amplifiers for Millimeter–Wavelength Active Arrays" Ford Microelectronics, Inc. IEEE 1989 pp. 127–130.

*Primary Examiner*—Benny T. Lee
*Assistant Examiner*—Justin P. Bettendorf
*Attorney, Agent, or Firm*—Wolf, Greenfield & Sacks, P.C.

[57] ABSTRACT

There is provided a small size phase shifter which can shift a phase by 180 degrees wherein the accuracy of preset phase is less dependent on frequency. The phase shifter comprises first to fourth switches provided between a first line pair and a second line pair. By turning the first and second switches ON and the third and fourth switches OFF, a signal inputted to the first line pair is outputted from the second line pair in phase. By turning the first and second switches OFF and the third and fourth switches ON, a signal inputted to the first line pair is outputted from the second line pair out of phase. A small-size phase shifter which has the accuracy of preset phase less dependent on frequency can then be obtained.

38 Claims, 33 Drawing Sheets

180-DEGREE PHASE SHIFTER

BACKGROUND OF THE INVENTION

1. Field of the Invention

The present invention relates to a phase shifter for shifting a phase of a microwave signal by forming switches such as FETs and slot lines on a semiconductor substrate made of silicon, gallium-arsenic (hereinafter referred to as GaAs), etc. and changing the slot lines over with such switches.

2. Description of the Related Art

FIG. 1 illustrates an example of the structure of a conventional line change-over phase shifter. In this figure, the reference numeral 1 designates a semiconductor substrate; 3*a* to 3*d* drain electrodes; 4*a* to 4*d* gate electrodes; 5*a* to 5*d* source electrodes; 6*a* to 6*d* FETs having drain electrodes 3*a* to 3*d*, gate electrodes 4*a* to 4*d* and source electrodes 5*a* to 5*d*; 7*a* to 7*d* bias resistances; 8*a* to 8*d* bias pads; 9*a* to 9*d* bias circuits comprising bias resistances 7*a* to 7*d* and bias pads 8*a* to 8*d*; 83*a* and 83*b* input/output microstrip line patterns; 84 a reference-phase microstrip line pattern; 85 a phase-preset microstrip line pattern; 86 a ground pattern formed on the bottom surface of semiconductor substrate 1. A bias voltage is impressed to gate electrodes 4*a* to 4*d* of FETs 6*a* to 6*d* from bias circuits 9*a* to 9*d* to operate FETs 6*a* to 6*d* as switches. Drain electrodes 3*a* to 3*d* and source electrodes 5*a* to 5*d* are usually grounded through bias circuits (not illustrated) in order to cause the drain voltage and source voltage of FETs 6*a* to 6*d* to have the same DC potential.

FIG. 2 is a diagram which explains the operations of the line change-over phase shifter illustrated in FIG. 1. In FIG. 2, reference numerals 16*a* and 16*b* designate input/output line pairs; 87*a* and 87*b* single-pole double-through switches (hereinafter referred to as SPDT switch); 88*a* reference-phase line pair; and 89 a phase-preset line pair.

Next, the operations will be explained. The circuit between drain electrodes 3*a* to 3*d* and source electrodes 5*a* to 5*d* of FETs 6*a* to 6*d* are turned ON and OFF to turn on and off a microwave signal by equalizing the potential of DC component of the drain and source voltages, for example, 0 V and switching the gate voltages between 0 V and the pinch-off voltage. Therefore, first FET 6*a* and second FET 6*b* are used as a pair and 0 V is applied to any one of gate electrodes 4*a*, 4*b*, while the pinch-off voltage to the other. When the bias voltages are changed over simultaneously, first and second FETs 6*a* and 6*b* operate as a SPDT switch. This SPDT switch corresponds to first SPDT switch 87*a* of FIG. 2. Similarly, third FET 6*c* and fourth FET 6*d* are used as a pair and 0 V is applied to any one of gate electrodes 4*c* and 4*d*, while the pinch-off voltage is applied to the other. When the bias voltages simultaneously are changed over, third and fourth FETs 6*c*, and 6*d* operate as a SPDT switch. This SPDT corresponds to second SPDT switch 87*b* of FIG. 2. Similarly input/output microstrip line patterns 83*a*, 83*b* of FIG. 1 respectively correspond to input/output line pairs 16*a*, 16*b* of FIG. 2. Reference-phase microstrip line pattern 84 of FIG. 1 corresponds to reference phase line pair 88 of FIG. 2, while phase-preset microstrip line pattern 84 of FIG. 1 to phase-preset line pair 89 of FIG. 2.

In FIG. 2, a microwave signal inputted from first input/output line pair 16*a* passes through first SPDT switch 87*a*, reference-phase line pair 88 and second SPDT switch 87*b* and is then outputted from second input/output line pair 16*b*. The phase of the microwave signal can be shifted by the difference in electrical length between the propagation paths by switching between SPDT switches 87*a*, 87*b* and changing the propagation path of the microwave signal to phase-preset line pair 89. Assuming that the difference in electrical length is defined as $\Delta L$, microwave signal frequency as f and the velocity of light as C, the amount of phase shift $\theta$ can be given by the formula: $\theta=2\pi f\ \Delta L/C$.

Since the conventional line change-over phase shifter operates on the basis of the principle explained above, if a large phase shift is required, phase-preset microstrip line pattern 85 illustrated in FIG. 1 is elongated, as can be understood from the above formula ($\theta=2\pi f\ \Delta L/C$) to obtain the phase shift. As a result, the conventional line change-over phase shifter is disadvantageous in that a circuit structure becomes larger in size and that a preset phase changes greatly with frequency as signal transmission line becomes longer.

SUMMARY OF THE INVENTION

The present invention has been proposed to overcome the problems described above and it is therefore an object of the present invention to provide a small-sized 180-degree phase shifter wherein the accuracy of the preset phase is less dependent on frequency.

A phase shifter of the present invention comprises a first input/output line pair, a second input/output line pair and first to fourth switches provided between these first and second line pairs. By turning ON and OFF these first to fourth switches, a line conductor of the first input/output line is switched between line and ground conductors of the second input/output line pair and a ground conductor of the first input/output line pair is switched between the line and ground conductors of the second input/output line pair. Consequently, the phase of the AC voltage transmitted can be phase-shifted by 180 degrees and a line for presetting the amount of phase shift can be omitted, and any change in frequency resulting from line length can be reduced.

In order to embody a phase shifter of the present invention, there is provided on a semiconductor substrate a first input/output slot line pattern pair, a second input/output slot line pattern pair and first to fourth FETs provided between those input/output line pairs and having gate electrodes formed in a direction parallel or perpendicular to the first and second input/output slot line pattern pairs, and a connection is switched between the first input/output slot line pattern pair and the second input/output slot line pattern pair by the first to fourth FETs.

The phase shifter can be reduced in size by arranging the first to fourth FETs in the shape of a ladder in a direction perpendicular to the first and second input/output slot line pattern pairs.

Each FET can be designed more freely by arranging the width of the first to fourth FETs in a direction perpendicular to the first and second input/output slot line pattern pairs.

The phase shifter can further be reduced in size by arranging the first to fourth FETs, having the gate electrodes formed in a direction perpendicular to the first and second input/output slot line pattern pairs, in the shape of a ladder in a direction parallel to the first and second input/output slot line pattern pairs.

The gate electrodes of the first to fourth FETs are connected to bias circuits each having a resistance or a line pattern.

The first to fourth FETs may respectively be replaced with a plurality of parallelly connected FETs, thereby reducing signal loss.

In order to embody the phase shifter of the present invention, a first input/output slot line pattern pair, a second input/output slot line pattern pair and first to fourth diodes provided between the pattern pairs are provided on one surface of the semiconductor substrate, and the connection is switched between the first input/output slot line pattern pair and the second input/output slot line pattern pair by the first to fourth diodes. This structure allows for more freedom of design and ensures a minimal signal loss.

In the phase shifter of the present invention, the first and second input/output coplanar line patterns can respectively be connected to the first and second input/output slot line pattern pairs, whereby on-wafer evaluation can be performed by means of an on-wafer prober.

In the phase shifter of the present invention, the first and second input/output microstrip line patterns can respectively be connected to the first and second input/output slot line pattern pairs, whereby the possibility of connection to other devices can be increased.

Ground patterns may be provided on the bottom surface of the semiconductor substrate in such a manner as to be opposite the first and second input/output coplanar line patterns and each return pattern of the coplanar line patterns may be connected to the ground patterns via holes, whereby on-wafer evaluation can be performed by using an RF prober.

In the phase shifter of the present invention, a ground pattern may be formed on the entire bottom surface of the semiconductor substrate. In this case, a first slot line pattern pair having one of the patterns narrower than the other can be provided between the first and second input/output slot line pattern pairs and the first input/output microstrip line pattern, and a second slot line pattern pair having one of the patterns narrower than the other can be provided between the second input/output slot line pattern pair and the second input/output microstrip line pattern. Such a structure ensures a stable operation of the phase shifter even if a ground pattern is formed on the entire bottom surface of the semiconductor substrate.

In the phase shifter of the present invention, a ground pattern may be provided on the entire bottom surface of the semiconductor substrate and the return pattern pairs of the first and second input/output coplanar line patterns may be connected to the ground pattern. In this case, a first slot line pattern pair having one of the patterns narrower than the other can be provided between the first input/output coplanar line pattern and the first input/output slot line pattern pair and a second slot line pattern pair having one of the patterns narrower than the other can be provided between the second input/output coplanar line pattern and the second input/output slot line pattern pair.

The phase shifter can operate stably by setting a total length of each microstrip line comprising each of the first and second slot line pattern pairs and the ground pattern to substantially a quarter of the wavelength of an operating frequency.

In the phase shifter of the present invention, a first capacitor one electrode of which is grounded can be connected to a junction point of the first input/output microstrip line pattern and the narrower pattern of the first slot line patterns and a second capacitor one electrode of which is grounded can be connected to the junction point of the second input/output microstrip line pattern and the narrower pattern of the second slot line patterns. This ensures that the phase shifter can operate stably even if a ground pattern is formed on the entire bottom surface of the semiconductor substrate.

In the phase shifter of the present invention, similar advantages can be drawn by connecting a first capacitor, one electrode of which is grounded, to the junction point of a signal line pattern of the first input/output coplanar line pattern having a grounded return pattern pair and the narrower pattern of the first slot line patterns and by connecting a second capacitor, one electrode of which is grounded, to the junction point of a signal line pattern of the second input/output coplanar line pattern having a grounded return pattern pair and the narrower pattern of the second slot line patterns.

In the phase shifter of the present invention, the series connection of the first capacitor and the fifth FET may be connected in parallel to the junction point of the first input/output microstrip line pattern and the first slot line pattern pair and a series connection of the second capacitor and sixth FET may be connected in parallel to the junction point of the second input/output microstrip line pattern and the second slot line pattern pair. This ensures that the phase shifter can operate stably by turning ON and OFF the fifth and sixth FETs even if a ground pattern is formed on the entire bottom surface of the semiconductor substrate.

In the phase shifter of the present invention, the influence of the ground pattern formed on the bottom surface of the semiconductor substrate can be reduced by connecting the series connection of the first capacitor and the fifth diode in parallel to the junction point of the first input/output microstrip line pattern and the first slot line pattern pair, by connecting the series connection of the second capacitor and the sixth diode in parallel to the junction point of the second input/output microstrip line pattern and the second slot line pattern pair and by changing the capacitances of the fifth and sixth diodes.

In the phase shifter of the present invention, the first microstrip line pattern having a ground pattern on the upper surface of the semiconductor substrate can be disposed between the first slot line pattern pair and the first input/output microstrip line pattern and the second microstrip line pattern having a ground pattern on the upper surface of the semiconductor substrate can be disposed between the second slot line pattern pair and second input/output microstrip line pattern. The ground patterns formed on the upper surface of the semiconductor substrate can reduce any influence of the ground pattern formed on the entire bottom surface of the semiconductor substrate.

In the phase shifter of the present invention, it is possible that the first microstrip line pattern having a ground pattern on the upper surface of the semiconductor substrate is disposed between the first input/output coplanar line pattern having a grounded return pattern pair and the first slot line pattern pair and that the second microstrip line pattern having a ground pattern on the upper surface of the semiconductor substrate is disposed between the second input/output coplanar line pattern having a grounded return pattern pair and the second slot line pattern pair.

In the phase shifter of the present invention, a ground pattern is provided between the first slot line pattern pair and the first input/output microstrip line pattern, the first parallel-plate capacitor uses a part of the ground pattern as the lower electrode thereof, the narrower pattern of the first slot line patterns is connected to an upper electrode of the first parallel-plate capacitor and the first input/output microstrip line pattern through air bridges, a ground pattern is provided between the second slot line pattern pair and the second input/output microstrip line pattern, the second parallel-plate capacitor uses a part of the ground pattern as the lower electrode thereof, and the narrower pattern of the second slot line patterns is connected to an upper electrode of the second parallel-plate capacitor and the second input/output microstrip line pattern through air bridges. Such a structure ensures that the influence of the ground pattern formed on the bottom surface of the semiconductor substrate can be reduced and that T-shaped low-pass filters having the desired characteristics can be constituted with the air bridges and the parallel-plate capacitors.

In the phase shifter of the present invention, similar advantages can be drawn by providing a ground pattern between the first input/output coplanar line pattern having a grounded return pattern pair and the first slot line pattern pair, providing a first parallel-plate capacitor using a part of the ground pattern as the lower electrode, and connecting the narrower pattern of the first slot line patterns to the upper electrode of the first parallel-plate capacitor and the signal line pattern of the first input/output coplanar line pattern through air bridges and by providing a ground pattern between the second input/output coplanar line pattern having a grounded return pattern pair and the second slot line pattern pair, providing a second parallel-plate capacitor using a part of the ground pattern as the lower electrode, and connecting the narrower pattern of the second slot line patterns to the upper electrode of the second parallel-plate capacitor and the signal line pattern of the second input/output coplanar line pattern through air bridges.

The phase shifter of the present invention may connect DC-cut capacitors to via holes formed to connect one of the input/output slot line patterns and the ground pattern. If positive voltages are applied to the gate and source electrodes of the first to fourth FETs, the gate electrodes thereof can be controlled by positive voltages. Further, voltages for controlling the diodes can be set freely to the desired values regardless of the ground voltage.

DESCRIPTION OF THE PREFERRED EMBODIMENTS

Figure 1:
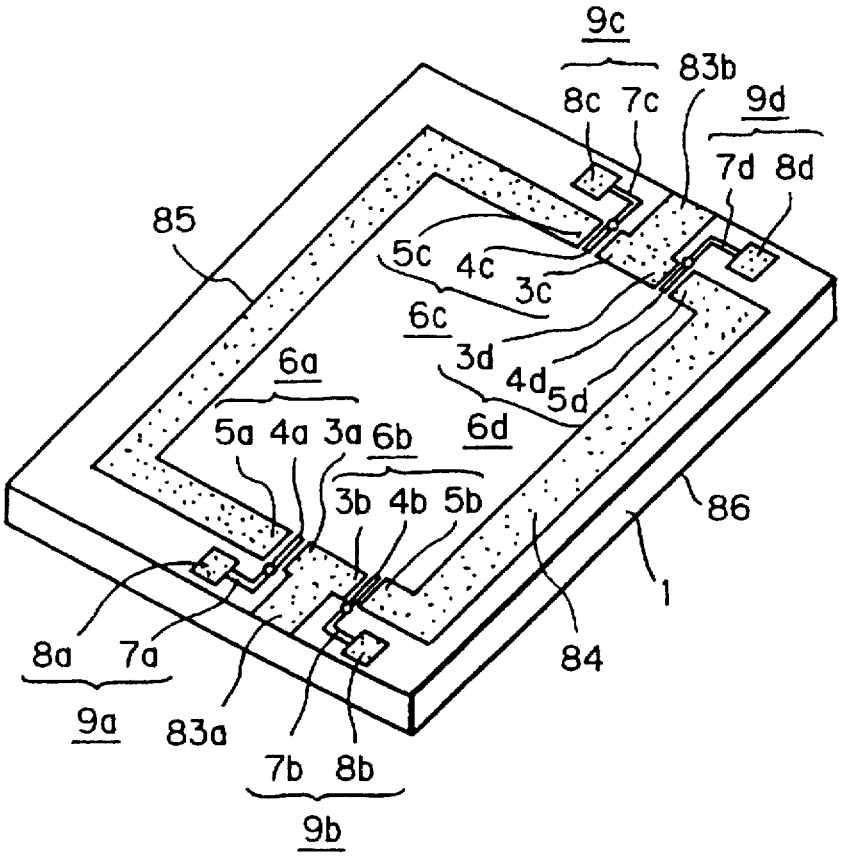
Fig. 1 PRIOR ART
FIG. 1 illustrates a schematic view of the structure of a conventional line switching type phase shifter.
Figure 2:
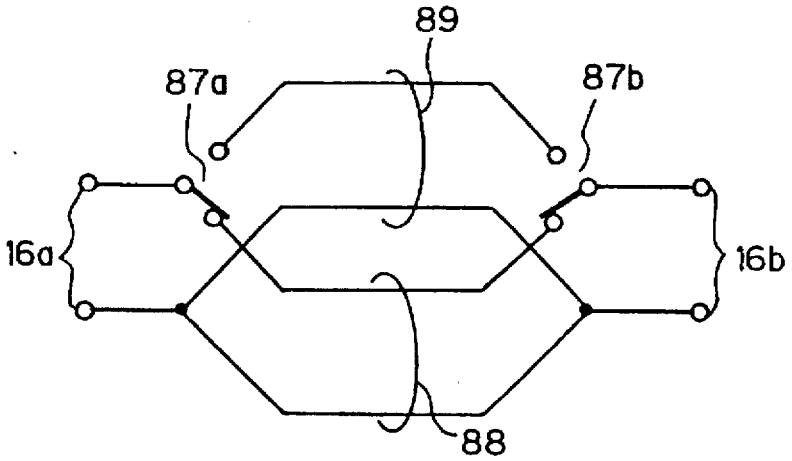
Fig. 2 PRIOR ART
FIG. 2 is a diagram for explaining operations of the phase shifter illustrated in FIG. 1.
Figure 3:
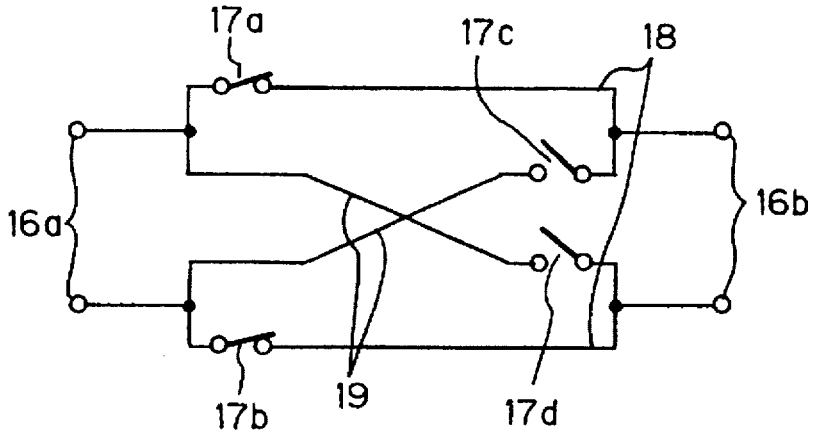
FIG. 3 illustrates a schematic view of the structure of the first embodiment of a phase shifter according to the present invention.
Figure 4:
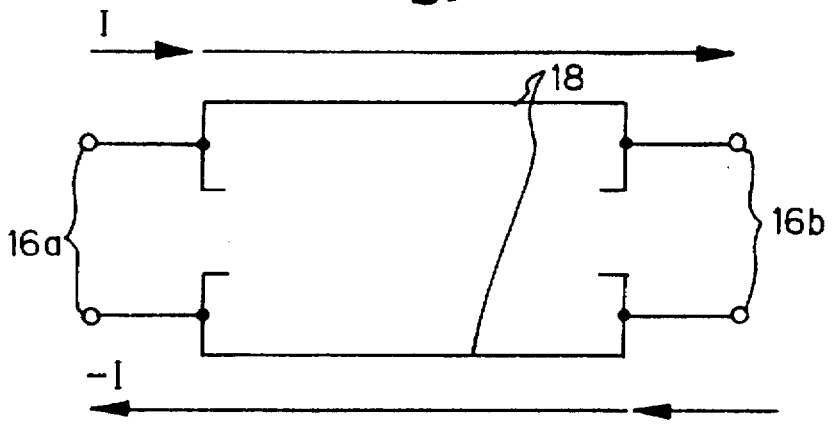
FIGS. 4 and 5 are diagrams for explaining operations of the phase shifter illustrated in FIG. 3.
Figure 5:
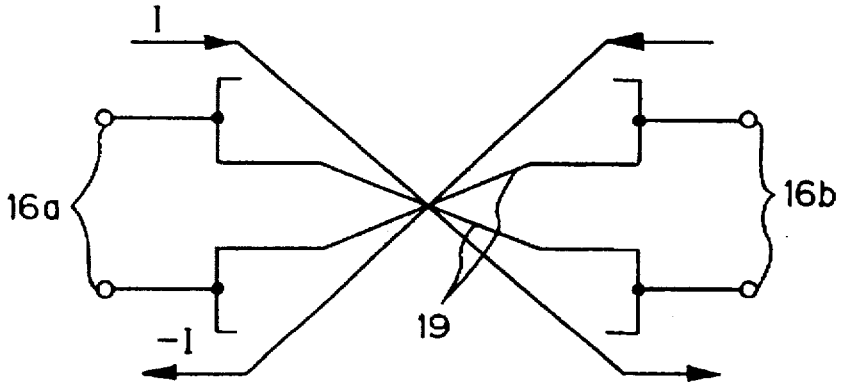

The preferred embodiments of the present invention will be explained hereunder with reference to the accompanying drawings. FIG. 3 illustrates the structure of an embodiment of a phase shifter of the present invention. In this figure, the reference numeral 16 designates an input/output line pair; 17*a*, 17*b*, 17*c* and 17*d* switches; 18 a line pair and 19 a crossing line pair. The remaining reference numerals designate elements like those illustrated in FIGS. 1 and 2. FIGS. 4 and 5 are diagrams for explaining operations of the phase shifter illustrated in FIG. 3.

In FIG. 3, when first and second switches 17*a*, 17*b* are turned ON and third and fourth switches 17*c*, 17*d* are turned OFF, a microwave signal inputted from first input/output line pair 16*a* is outputted from second input/output line pair 16 through first switch 17*a*, second switch 17*b* and line pair 18. The current path in the above operation is illustrated in FIG. 4. Next, when first and second switches 17*a*, 17*b* are turned OFF and third and fourth switches 17*c*, 17*d* are turned ON in FIG. 3, a microwave signal inputted from first input/output line pair 16*a* is outputted from second input/output line pair 16*b* through crossing line pair 19, third switch 17*c* and fourth switch 17*d*. A current path in the above operation is illustrated in FIG. 5. It is noted that, in FIG. 5, the relationship between the line and the ground conductors forming first input/output line pair 16*a* is the reverse of that between the line and ground conductors forming second input/output pair 16*b*, in FIG. 4. Therefore, the polarity of an AC voltage propagated is reversed with respect to crossing line pair 19. This fact is equivalent, if attention is paid to the phase of the AC signal, to a phase inversion, that is, to a phase shift of 180 degrees. Such an operation occurs regardless of frequency. Consequently, if all the phase shifts which occur at the first to fourth switches when those switches are ON in FIG. 4 are equal to those in FIG. 5 and electrical lengths of line pair 18 and crossing line pair 19 in FIG. 4 are equal to those in FIG. 5, the phase of the microwave signal outputted to second input/output line pair 16*b* in the case of FIG. 4 is different from that of the microwave signal outputted to second input/output line pair 16*b* in the case of FIG. 5 by 180 degrees at any frequency.

Figure 6:
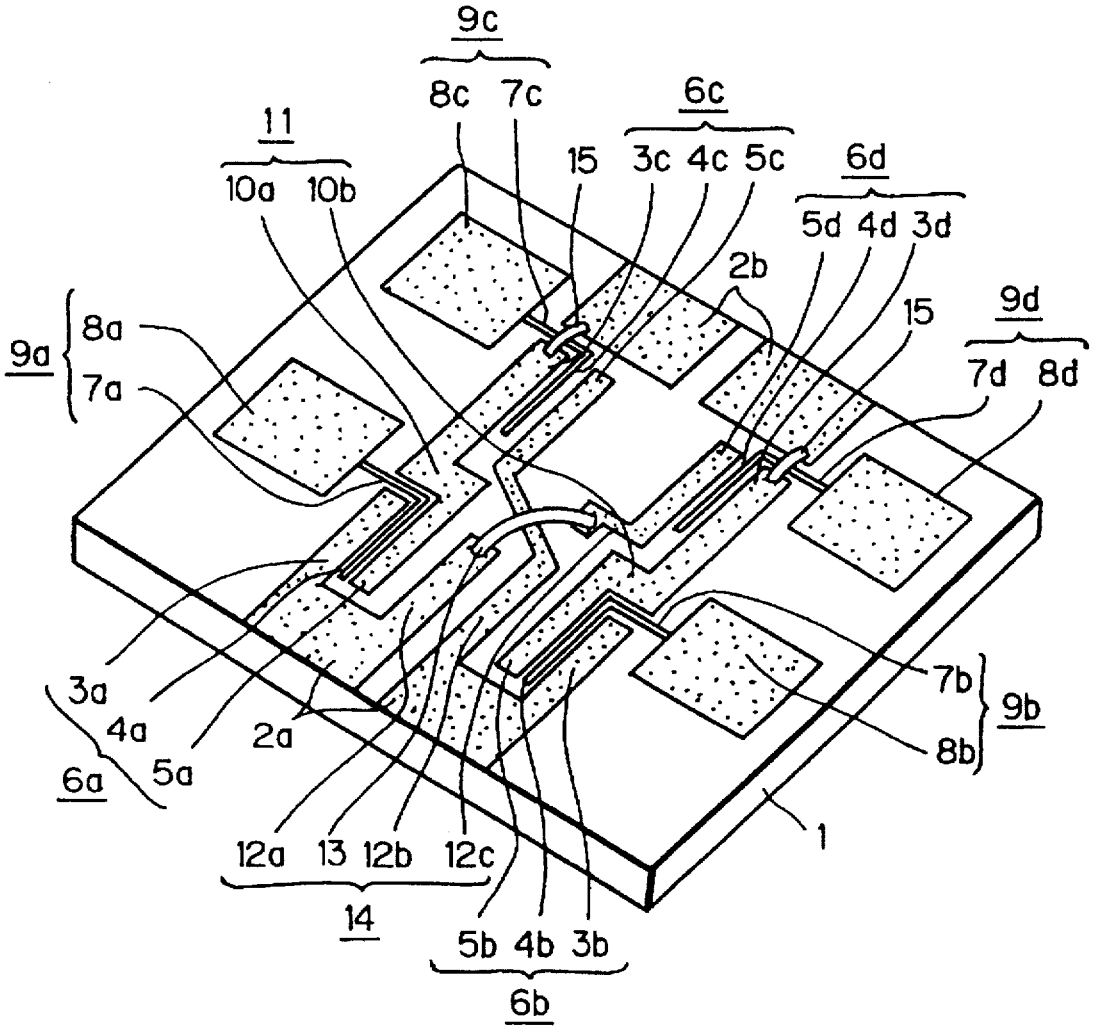
FIG. 6 illustrates a schematic view of the structure of the second embodiment of a phase shifter according to the present invention.

FIG. 6 illustrates the structure of the second embodiment of a phase shifter according to the present invention. In the second embodiment, of the first embodiment is integrally formed on a semiconductor substrate, as shown in FIG. 6. In this figure, the reference numeral 2*a* and 2*b* designate input/output slot line pattern pairs; 10*a* and 10*b* connecting line patterns; 11 a line pair constituted of line connecting patterns 10*a*, 11*b*; 12*a*, 12*b*, 12*c* and 12*d* line connecting patterns; 13 an air bridge; 14 a crossing line pair constituted of line connecting patterns 12*a*, 12*b*, 12*c* and air bridge 13; 15, an air bridge. The remaining reference numerals define like elements of the conventional phase shifter shown in FIG. 1.

As illustrated in FIG. 6, gate electrodes 4*a* to 4*d* of first to fourth FETs 6*a* to 6*d* are formed to be in parallel to input/output slot line pattern pairs 2*a*, 2*b*. One of the patterns of first input/output slot line pattern pair 2*a* is connected to drain electrode 3*a* of first FET 6*a* and source electrode 5*d* of fourth FET 6*d*, and the other of the patterns of first input/output slot line pattern pair 2*a* is connected to drain electrode 3*b* of second FET 6*b* and source electrode 5*c* of third FET 6*c*. Further, one of the patterns of second input/output slot line pattern pair 2*b* is connected to drain electrode 3*c* of third FET 6*c*; the other of the patterns of second input/output slot line pattern pair 2*b* is connected to drain electrode 3*d* of fourth FET 6*d*; source electrode 5*a* of first FET 6*a* is connected to drain electrode 3*c* of the third FET 6*c*; and source electrode 5*b* of second FET 6*b* is connected to drain electrode 3*d* of fourth FET 6*d*.

In FIG. 6, gate bias voltages are applied to gate electrodes 4*a* to 4*d* of FETs 6*a* to 6*d* from bias circuits 9*a* to 9*d* to cause FETs 6*a* to 6*d* to perform switching operations. Drain electrodes 3*a* to 3*d* and source electrodes 5*a* to 5*d* of FETs 6*a* to 6*d* are grounded through grounding circuits (not illustrated) so that these electrodes are placed at the same DC potential.

If the drain and source electrodes are at the same DC potential, for example, 0 V, each FET performs a switching operation for passing and stopping a microwave signal between the drain electrode and the source electrode by switching the gate voltage between 0 V and the pinch-off voltage. Therefore, first FET 6*a*, second FET 6*b*, third FET 6*c* and fourth FET 6*d* in FIG. 6 respectively correspond to switches 17*a*, 17*b*, 17*c*, 17*d* in FIG. 3. Line pair 11 in FIG. 6 corresponds to line pair 18 in FIG. 3; crossing line pair 14 in FIG. 6 to crossing line pair 19 in FIG. 3; and first input/output slot line pattern pair 2*a* and second input/output slot line pattern pair 2*b* in FIG. 6 to first input/output line pair 16*a* and second input/output line pair 16*b* in FIG. 3, respectively.

Figure 7:
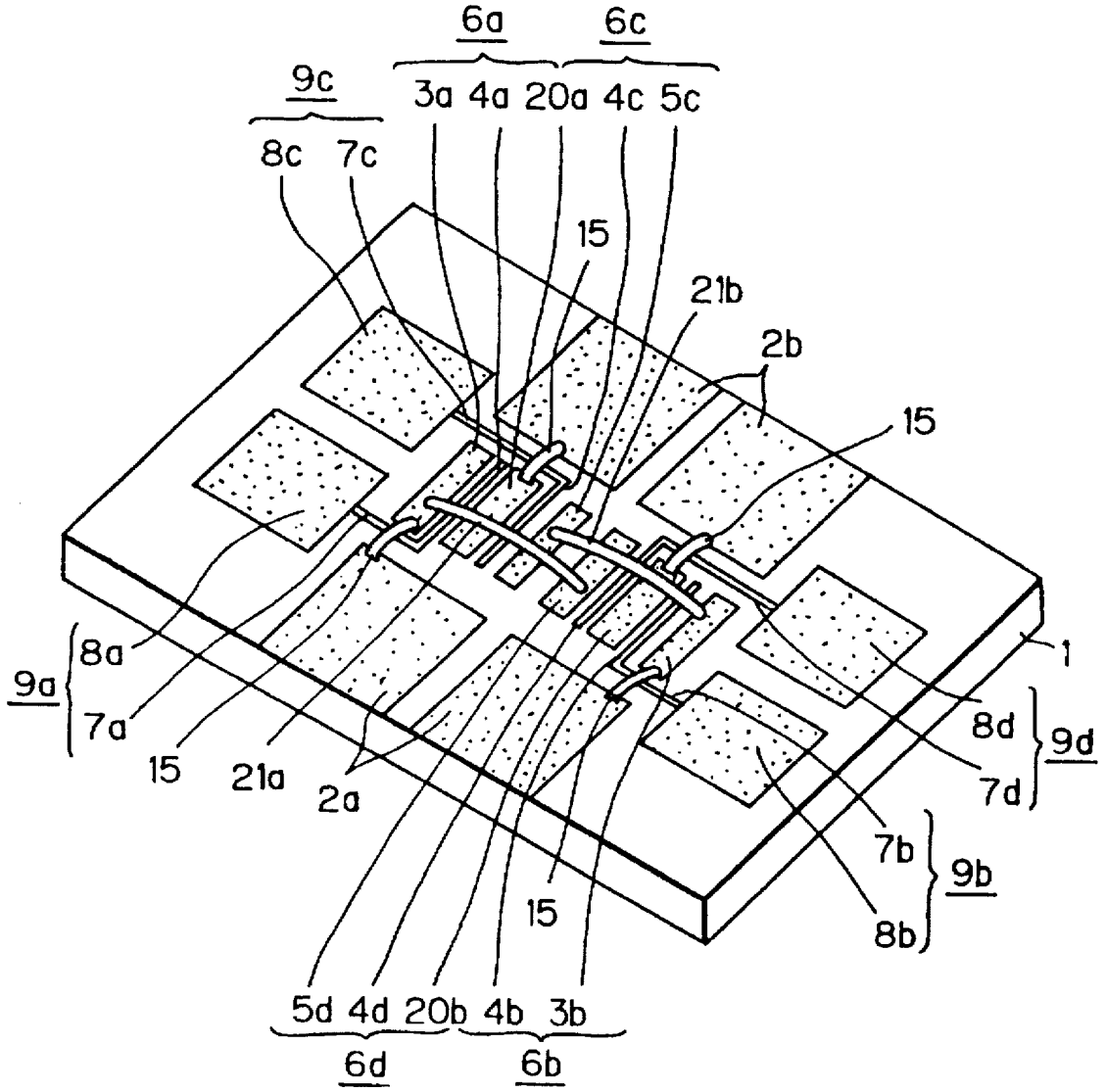
FIG. 7 illustrates a schematic view of the structure of the third embodiment of a phase shifter according to the present invention.

FIG. 7 illustrates the structure of the third embodiment of a phase shifter according to the present invention. In this figure, 21*a*, 21*b* define air bridges. In FIG. 7, a drain-source common electrode 20*a* operates as source electrode 5*a* of first FET 6*a* and drain electrode 3*c* of third FET 6*c* shown in FIG. 6, and a drain-source common electrode 20*b* operates as source electrode 5*b* of second FET 6*b* and drain electrode 3*d* of fourth FET 6*d*. Drain electrode 3*d* of first FET 6*a* and source electrode 5*d* of fourth FET 6*d* are connected to air bridge 21*a*, while drain electrode 3*b* of second FET 6*b* and source electrode 5*c* of third FET 6*c* are connected to air bridge 21*b*.

Figure 8:
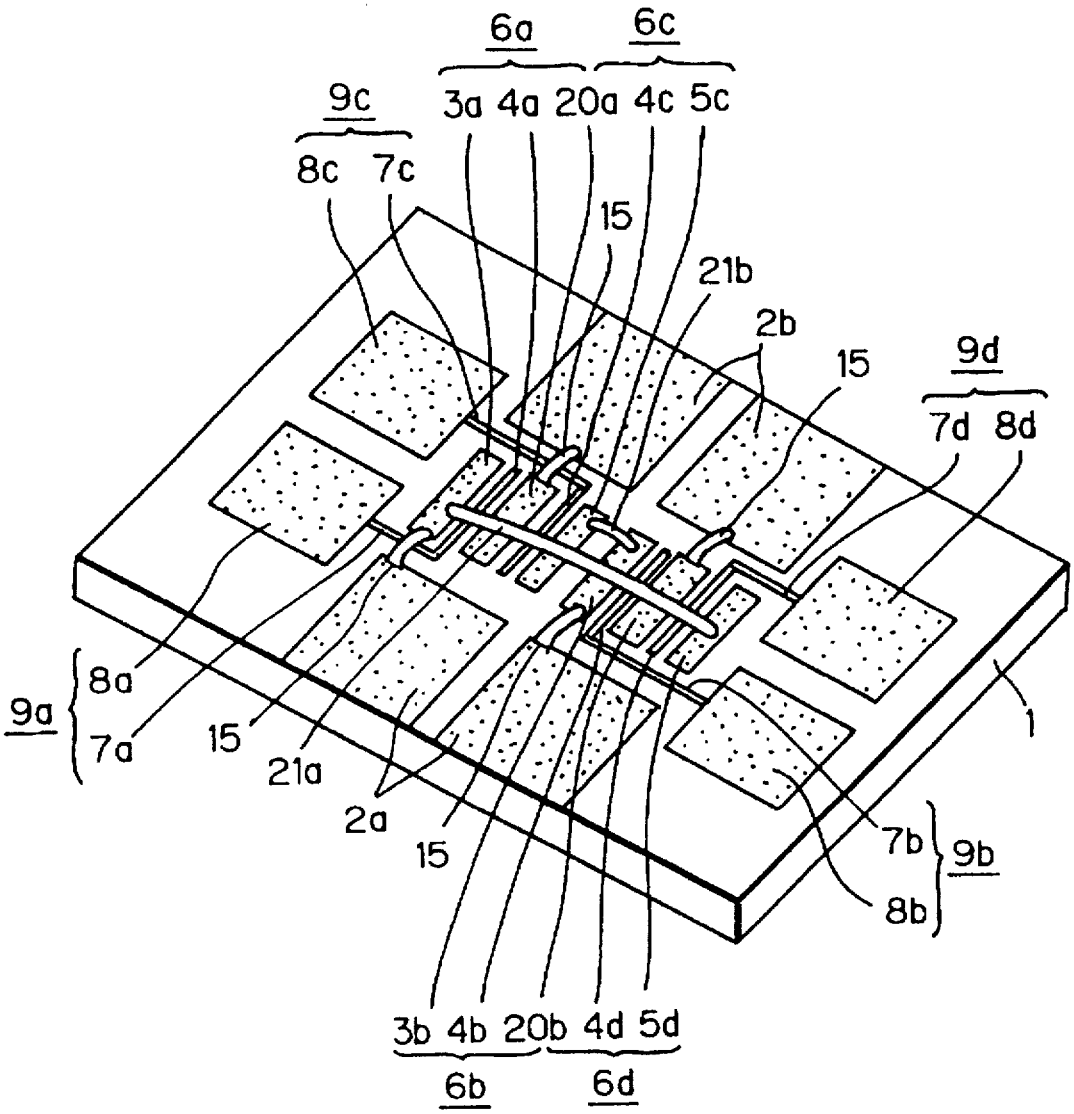
FIG. 8 is a diagram illustrating a modification to the phase shifter of the third embodiment according to the present invention.
Figure 9:
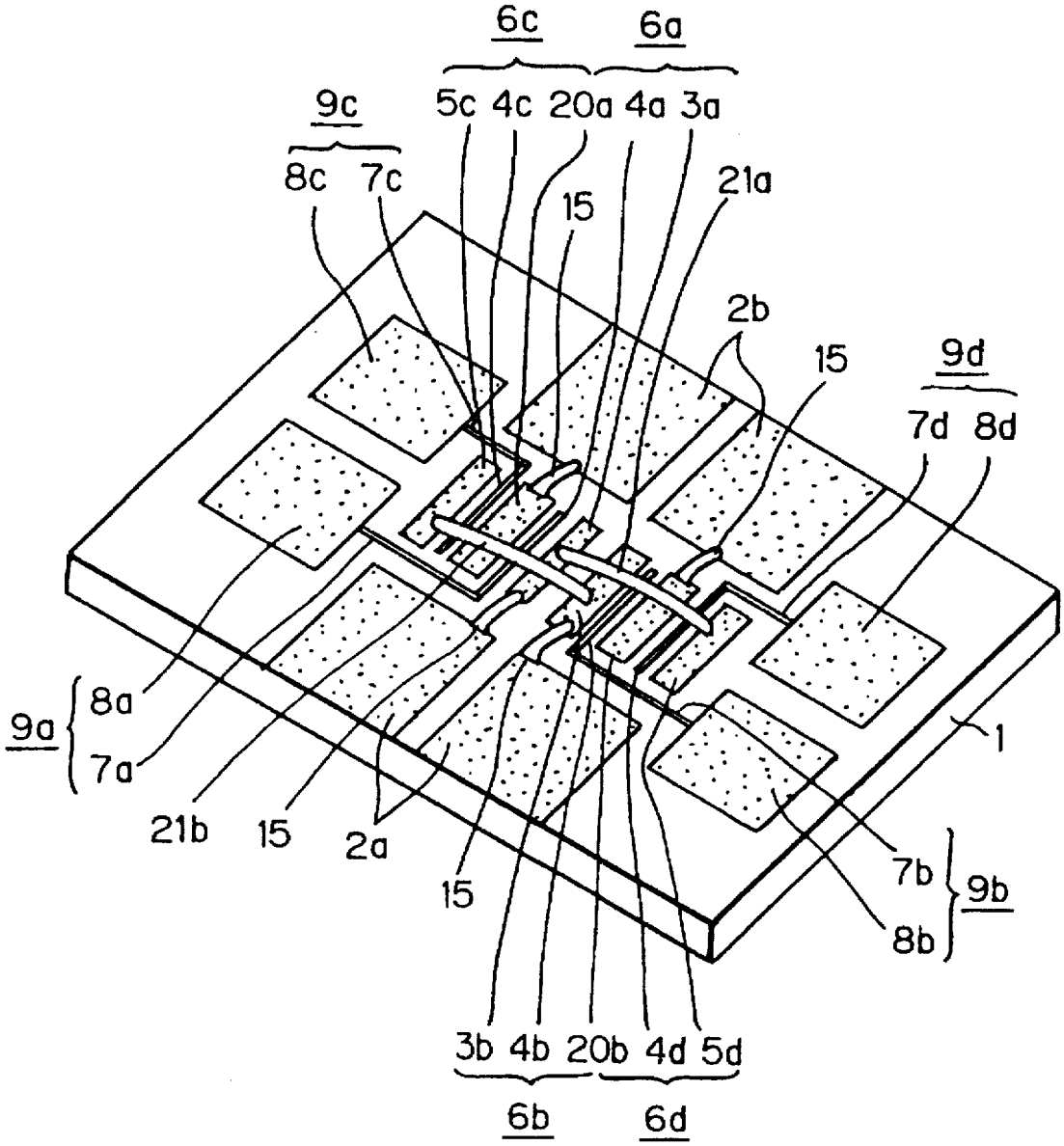
FIG. 9 is a diagram illustrating another modification to the phase shifter of the third embodiment according to the present invention.

With this structure, line pair 11 and crossing line pair 14 illustrated in FIG. 6 can be omitted and first to fourth FETs 6*a* to 6*d* can be arranged in the shape of a ladder in a direction perpendicular to input/output slot line pattern pair 2 whereby the phase shifter of the third embodiment can be formed smaller than the structure of FIG. 6. Modifications to the third embodiment are illustrated in FIGS. 8 and 9. In FIG. 8, third FET 6*c* and FET 6*d* of figure are interchanged in comparison with FIG. 7. In FIG. 9, first FET 6*a* and second FET 6*b* are interchanged in comparison with FIG. 8. Both modifications provide similar advantages.

Figure 10:
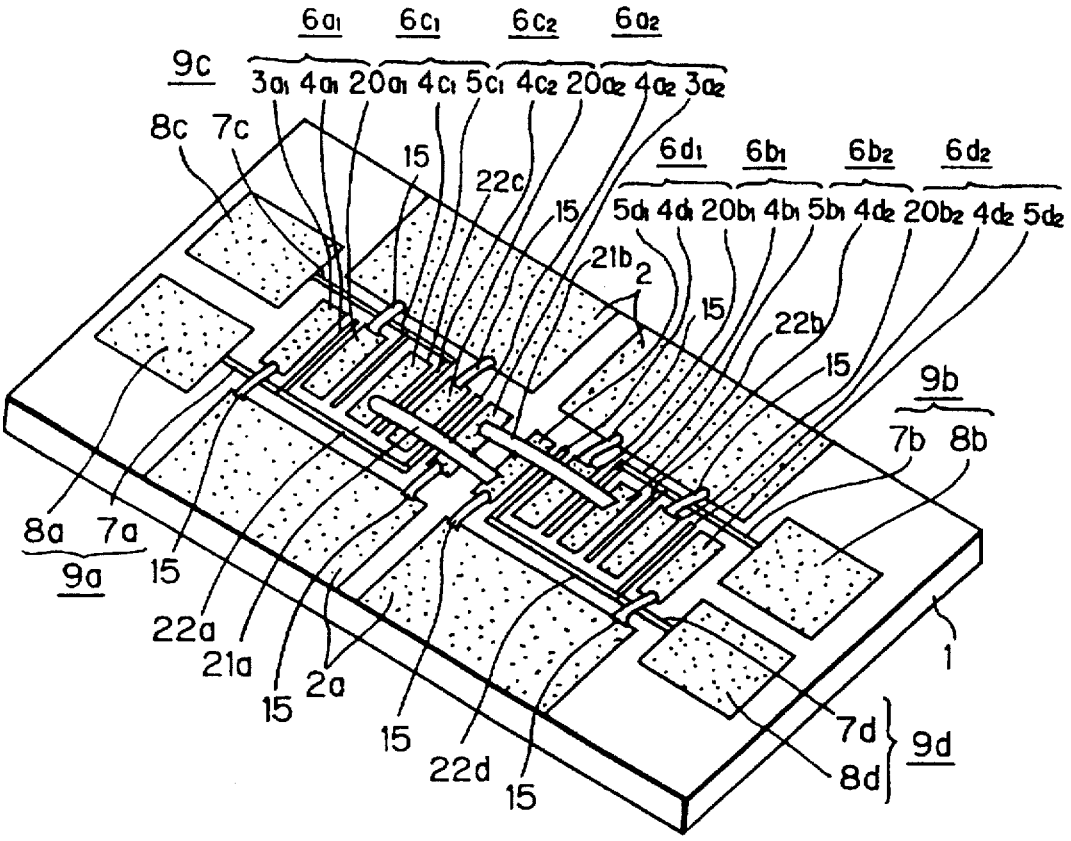
FIG. 10 illustrates a schematic view of the structure of the fourth embodiment of a phase shifter according to the present invention.
Figure 11:
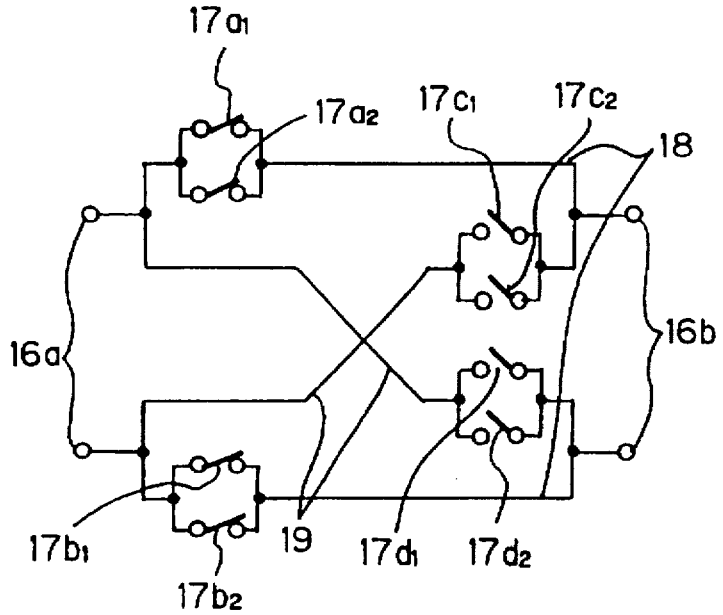
FIG. 11 is a diagram for explaining operations of the phase shifter illustrated in FIG. 10.

FIG. 10 illustrates the structure of the fourth embodiment of a phase shifter according to the present invention. In this figure, 22*a* to 22*d* define gate electrode connecting line patterns. FIG. 11 is a diagram for explaining operations of the phase shifter illustrated in FIG. 10. In FIGS. 10 and 11, first FETs 6*a*1, 6*a*2 correspond respectively to first switches 17*a*1, 17*a*2; second FETs 6*b*1, 6*b*2 to second switches 17*d*1, 17*d*2; third FETs 6*c*1, 6*c*2 to third switches 17*c*1, 17*c*2; and fourth FETs 6*d*1, 6*d*2 to fourth switches 17*d*1, 17*d*2. Transmission loss of the phase shifter of the present invention substantially depends on a series resistance between the drain and source electrodes when the FET is ON. In order to lower the transmission loss, the series resistance must be reduced, and it is effective to lower the series resistance by connecting a couple of FETs in parallel as in the fourth embodiment. The fourth embodiment illustrated in FIG. 10 forms the respective switches with a couple of parallel FETs (FIG. 11) on the basis of the third embodiment and operates in the same manner as the second and third embodiments reducing size and transmission loss.

Figure 12:
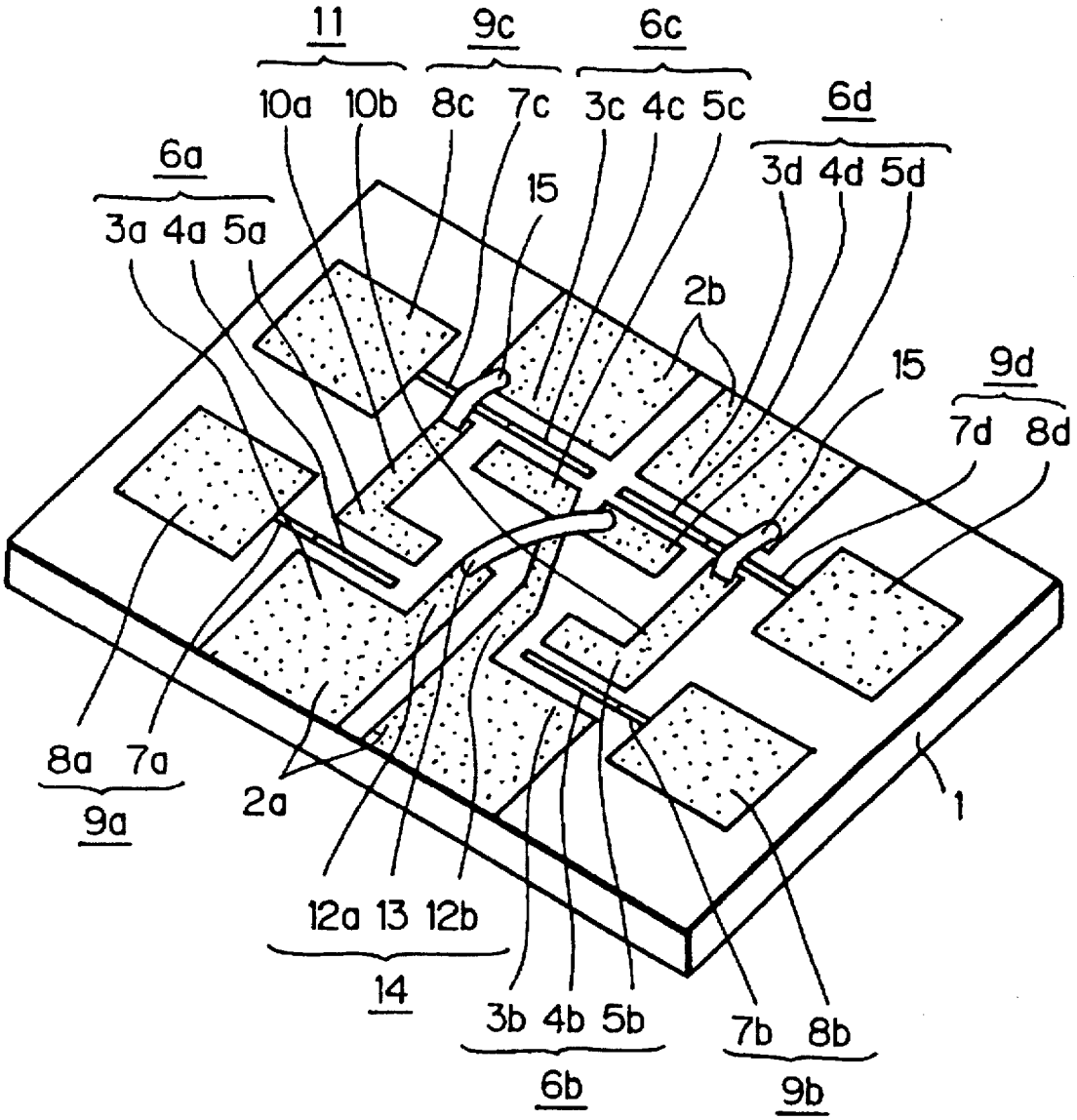
FIG. 12 illustrates a schematic view of the structure of the fifth embodiment of a phase shifter according to the present invention.

FIG. 12 illustrates the structure of the fifth embodiment of a phase shifter according to the present invention. In FIG. 12, gate electrodes 4*a* to 4*d* of FETs 6*a* to 6*d* in the structure illustrated in FIG. 6 are arranged in the direction perpendicular to input/output slot line pattern pairs 2*a*, 2*b*. The phase shifter according to the fifth embodiment can provide advantages similar to the second embodiment and reduce the width perpendicular to the direction interconnecting the input/output pattern pairs.

Figure 13:
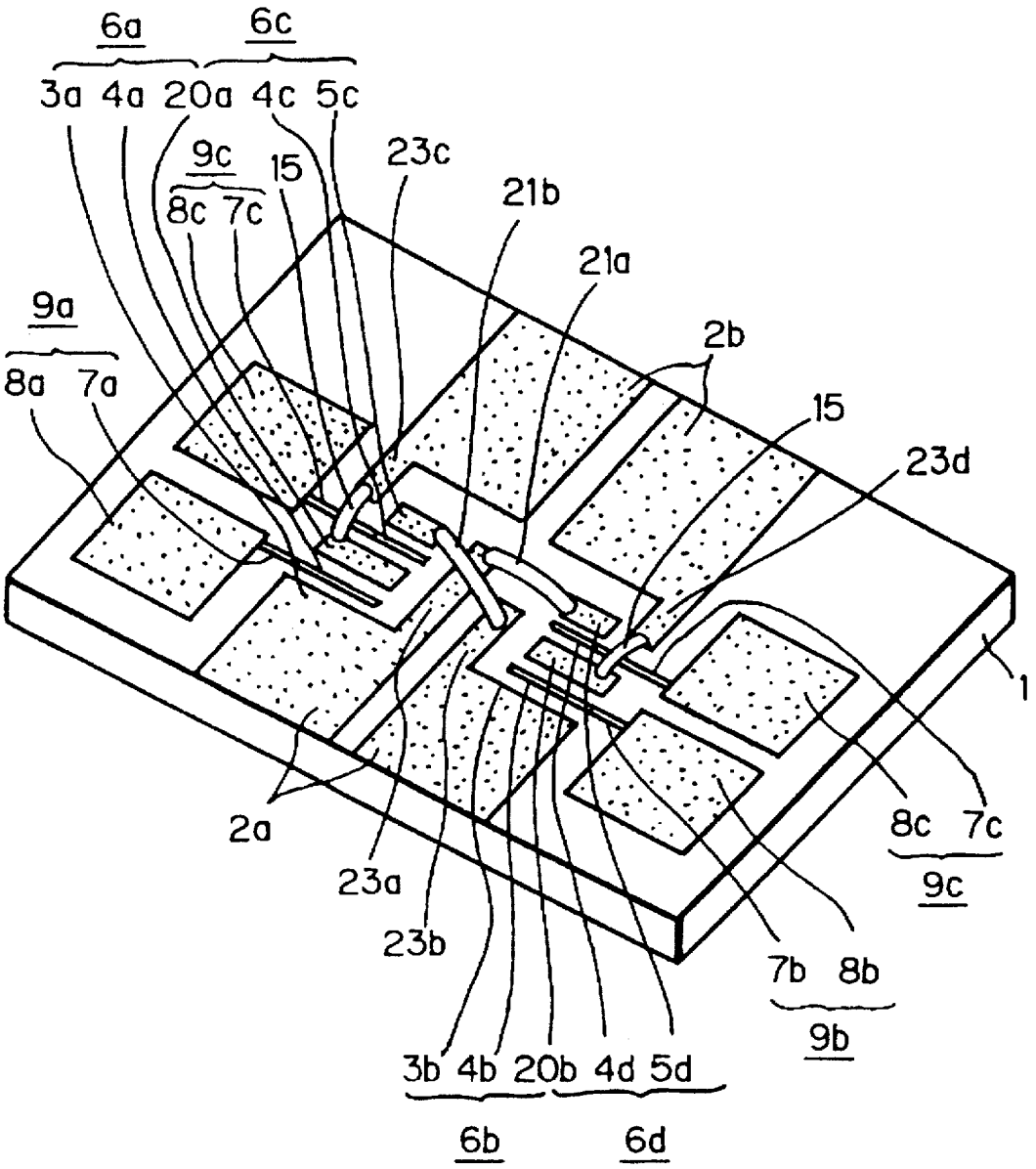
FIG. 13 illustrates a schematic view of the structure of the sixth embodiment of a phase shifter according to the present invention.

FIG. 13 illustrates the structure of sixth embodiment of a phase shifter according to the present invention. In this figure, 23*a* to 23*d* define line connecting patterns. In FIG. 13, a drain-source common electrode 20*a* serves as in the case of FIG. 12, as source electrode 5*a* of first FET 6*a* and drain electrode 3*c* of third FET 6*c*, and a drain-source common electrode 20*b* serves as source electrode 5*b* of second FET 6*b* and drain electrode 3*d* of fourth FET 6*d*. Drain electrode 3*a* of first FET 6*a* is connected to source electrode 5*d* of fourth FET 6*d* through air bridge 21*a* and line connecting pattern 23*a*, while drain electrode 3*b* of second FET 6*b* is connected to source electrode 5*c* of third FET 6*c* through air bridge 21*b* and line connecting pattern 23*b*. Structured such, first to fourth FETs 6*a* to 6*d* are arranged in the shape of a ladder in parallel to input/output slot line pattern pairs 2*a*, 2*b* and the phase shifter of the sixth embodiment can be formed to be smaller than the structure of FIG. 12.

Figure 14:
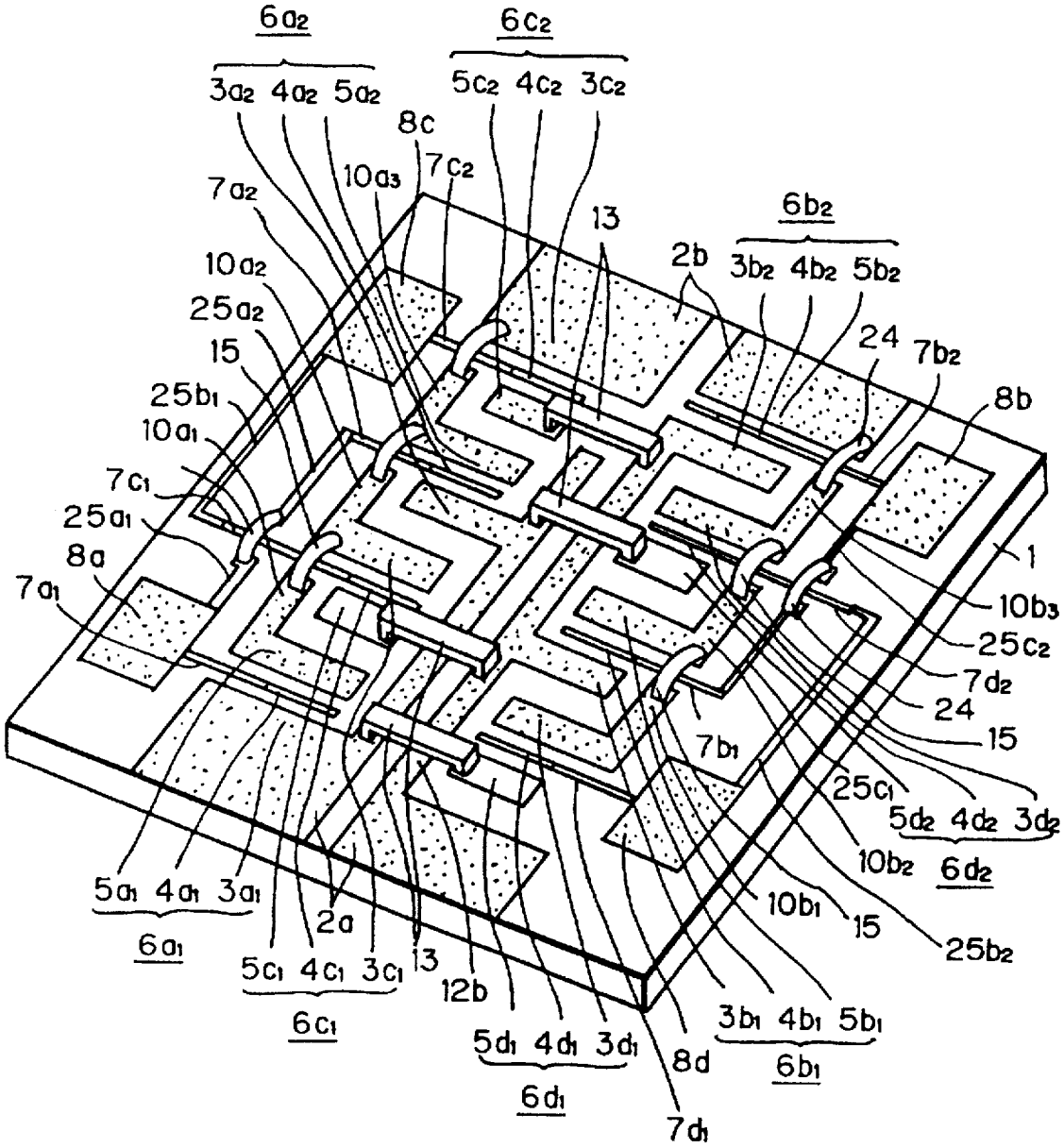
FIG. 14 illustrates a schematic view of the structure of the seventh embodiment of a phase shifter according to the present invention.

FIG. 14 illustrates the structure of the seventh embodiment of a phase shifter according to the present invention. In this figure, the reference numeral 24 designates an air bridge; and 25*a*1, 25*a*2, 25*b*1, 25*b*2, 25*c*1, 25*c*2 define gate electrode connecting patterns. In FIG. 14, first FETs 6*a*1, 6*a*2 respectively correspond to first switches 17*a*1, 17*a*2; second FETs 6*b*1, 6*b*2 to second switches 17*d*1, 17*d*2; third FETs 6*c*1, 6*c*2 to third switches 17*c*1, 17*c*2; and fourth FETs 6*d*1, 6*d*2 to fourth switches 17*d*1, 17*d*2. As is already explaining above, transmission loss of the phase shifter according to the present invention substantially depends on a series resistance between the drain and source electrodes when each FET is ON. In order to reduce such a transmission loss, it is required to reduce the series resistance. To this end, it is effective to connect a couple of FETs in parallel. The seventh embodiment is structured to have an equivalent circuit illustrated in FIG. 11 by forming each switch with a couple of parallel FETs on the basis of the sixth embodiment and therefore the phase shifter of the seventh embodiment operates in the same manner as the fourth and fifth embodiments and reduces size and transmission loss.

Figure 15:
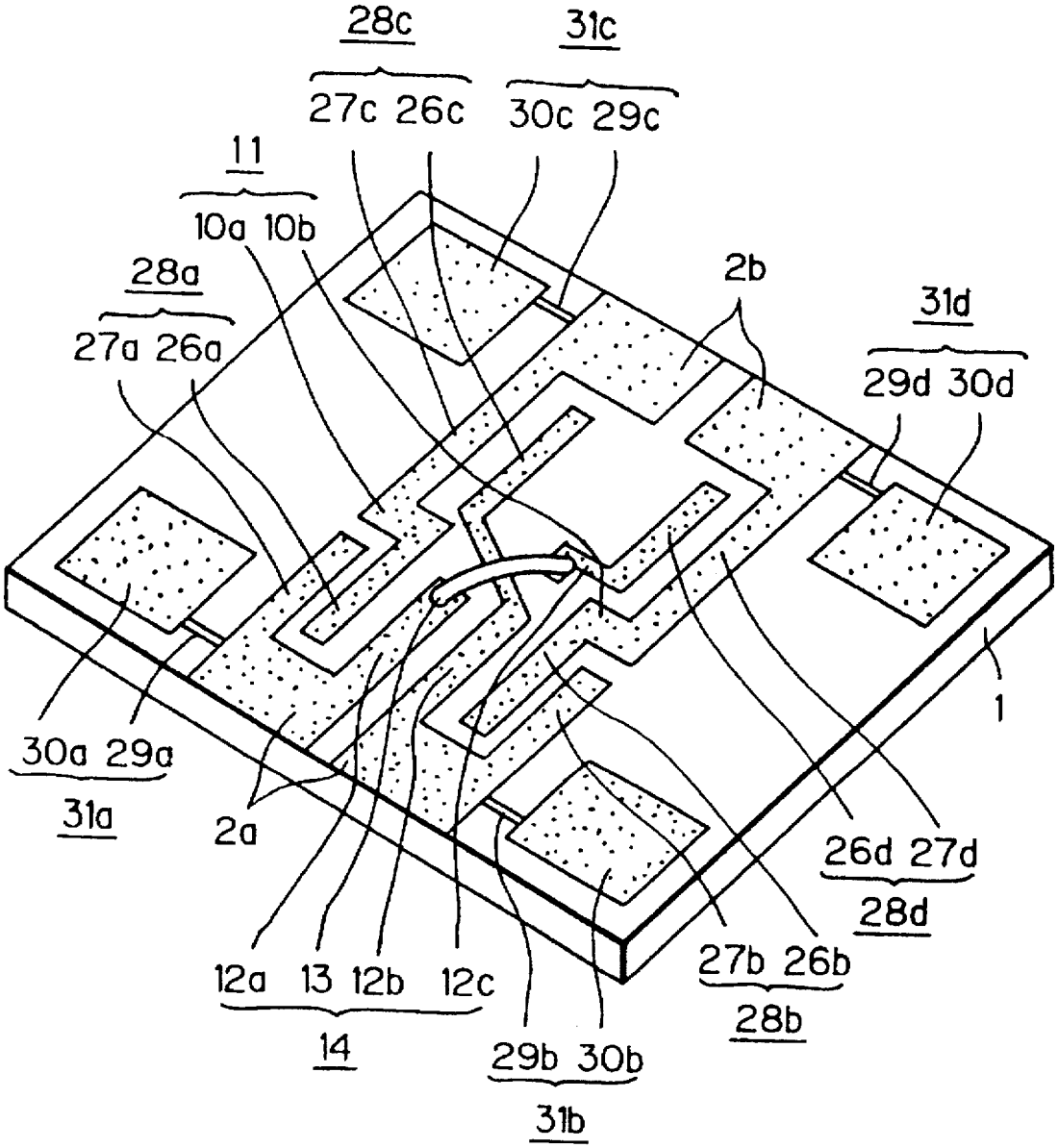
FIG. 15 illustrates a schematic view of the structure of the eighth embodiment of a phase shifter according to the present invention.

FIG. 15 illustrates the structure of the eighth embodiment of a phase shifter according to the present invention. In this figure, the reference numerals 26*a* to 26*d* define anode electrodes of diodes 28*a* to 28*d*; 27*a* to 27*d* cathode electrodes of diodes 28*a* to 28*d* which are, for example, Schottky barrier diodes and PIN diodes; 29*a* to 29*d* bias resistances; and 30*a* to 30*d* bias pads. These bias resistances and bias pads form bias circuits 31*a* to 31*d*.

In operation, diodes 28*a* to 28*d* perform the switching operations for passing and cutting off a microwave signal by changing the voltages between anode electrodes 26*a* to 26*d* and cathode electrodes 27*a* to 27*d* between the forward and backward voltages, and thus first, second, third and fourth diodes 31*a*, 31*b*, 31*c*, 31*d* in FIG. 15 respectively correspond to switches 17*a*, 17*b*, 17*c*, 17*d* in FIG. 13. The eighth embodiment therefore functions on the basis of the same principle as that of the first embodiment and exhibits advantages similar to that of the first embodiment.

Figure 16:
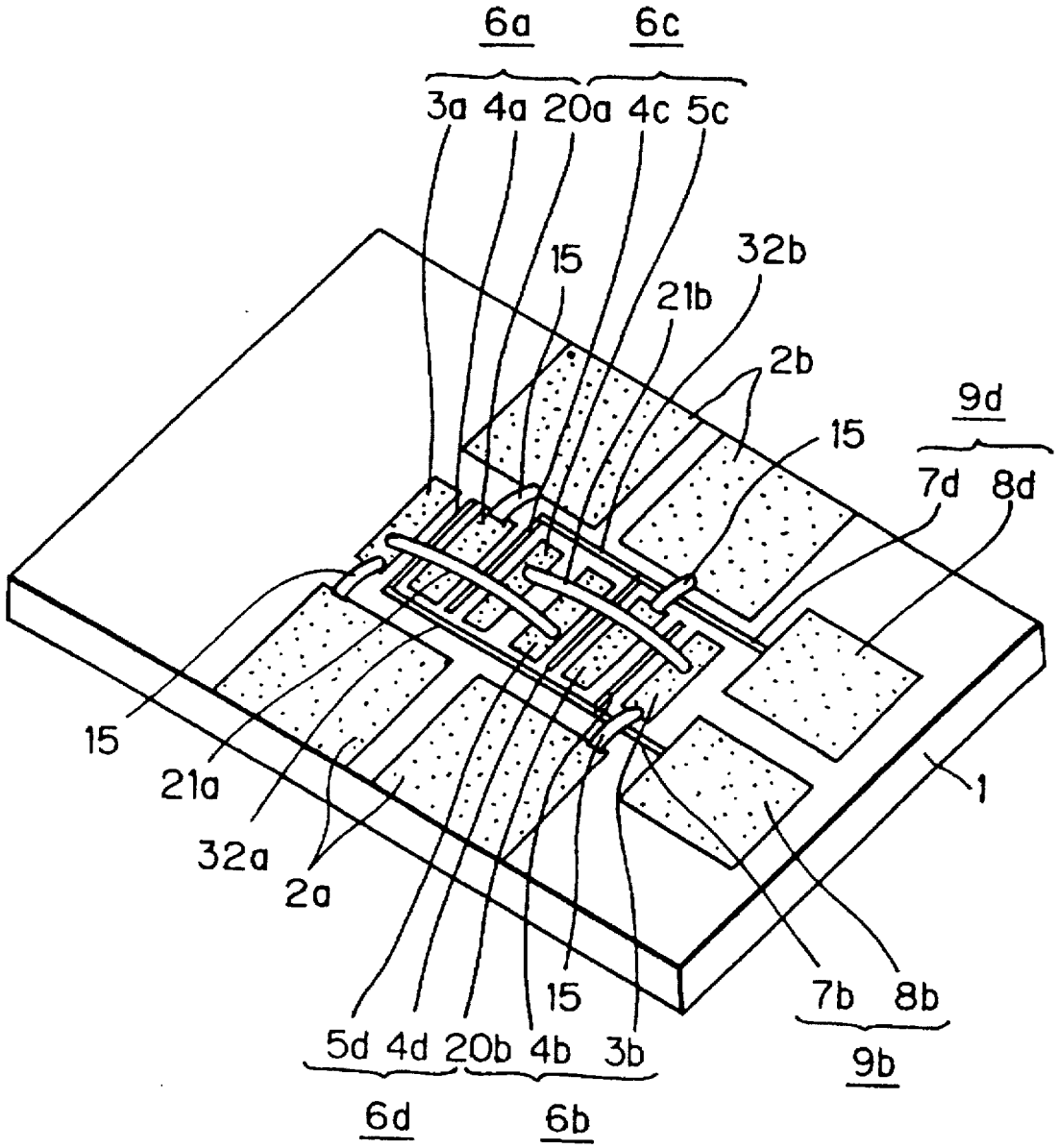
FIG. 16 illustrates a schematic view of the structure of the ninth embodiment of a phase shifter according to the present invention.

FIG. 16 illustrates the structure of the ninth embodiment of a phase shifter according to the present invention. In this figure, the reference numerals 32*a* and 32*b* define gate electrode connecting patterns. In FIG. 16, gate electrode 4*a* of first FET 6*a* is connected to gate electrode 4*b* of second FET 6*b* through gate electrode connecting pattern 32*a*, while gate electrode 4*c* of third FET 6*c* is connected to gate electrode 4*d* of fourth FET 6*d* through gate electrode connecting pattern 32*b*. This embodiment has been proposed to eliminate bias circuits 9*a* and 9*c* for the purpose of size reduction by noticing the fact that first and second FETs 6*a* and 6*b* operate at the same gate bias and that third and the fourth FETs 6*c* and 6*d* operate at the same gate bias. The ninth embodiment can be considered to be a modification to the phase shifter illustrated in FIG. 8. The phase shifters illustrated in FIG. 6, FIGS. 8 to 10 and 12 to 14 can also be modified in the same manner to exhibit a similar effect.

Figure 17:
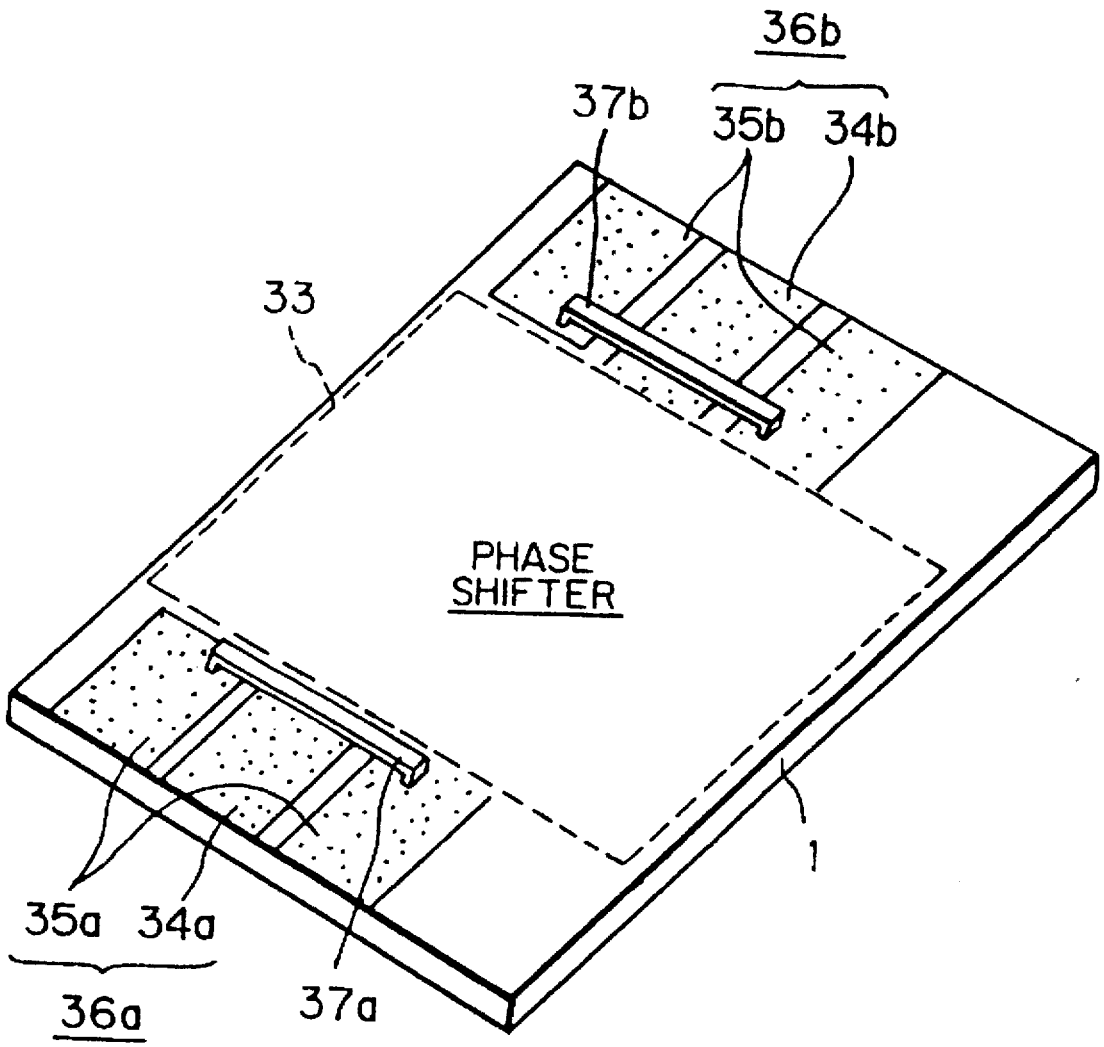
FIG. 17 illustrates a schematic view of the structure of the tenth embodiment of a phase shifter according to the present invention.
Figure 18:
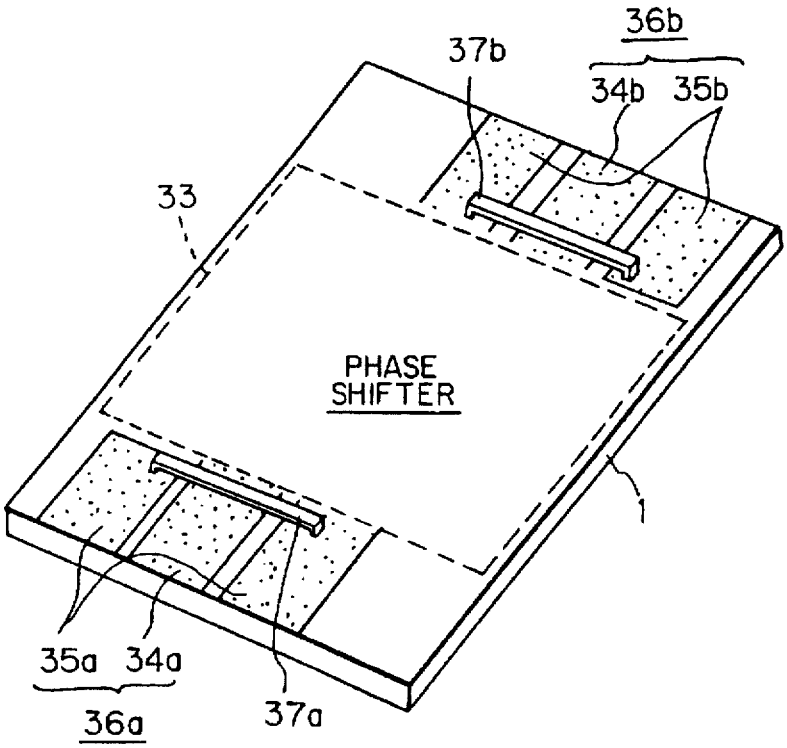
FIG. 18 is a diagram illustrating a modification to the phase shifter of the tenth embodiment according to the present invention.

FIG. 17 illustrates the structure of the tenth embodiment of a phase shifter according to the present invention. In this figure, the reference numeral 33 defines one of the phase shifters explained in the second to ninth embodiments 34*a*, 34*b* signal line patterns for coplanar lines; 35*a*, 35*b* return pattern pairs for coplanar lines; 36*a*, 36*b* input/output coplanar line patterns comprising signal line patterns 34*a*, 34*b* and return pattern pair 35*a*, 35*b*; and 37*a*, 37*b* air bridges for connecting return pattern pairs 35*a*, 35*b*. The type of input/output line can be converted from the slot line to the coplanar line by connecting one of input/output slot line patterns 2*a* to signal line pattern 34*a* and the other of input/output slot line patterns 2*a* connects to one of the return patterns 35*a*. Similarly, input/output slot line pattern pair 2*b*, signal line pattern 34*b* and return pattern pair 35*b* are interconnected. The tenth embodiment enables an on-wafer test using a microwave on-wafer prober which mainly utilizes coplanar lines. It is noted that similar advantages can be brought about by interconnecting input/output coplanar line pattern 36*b* and input/output slot line pattern pair 2*b* as illustrated in FIG. 18.

Figure 19:
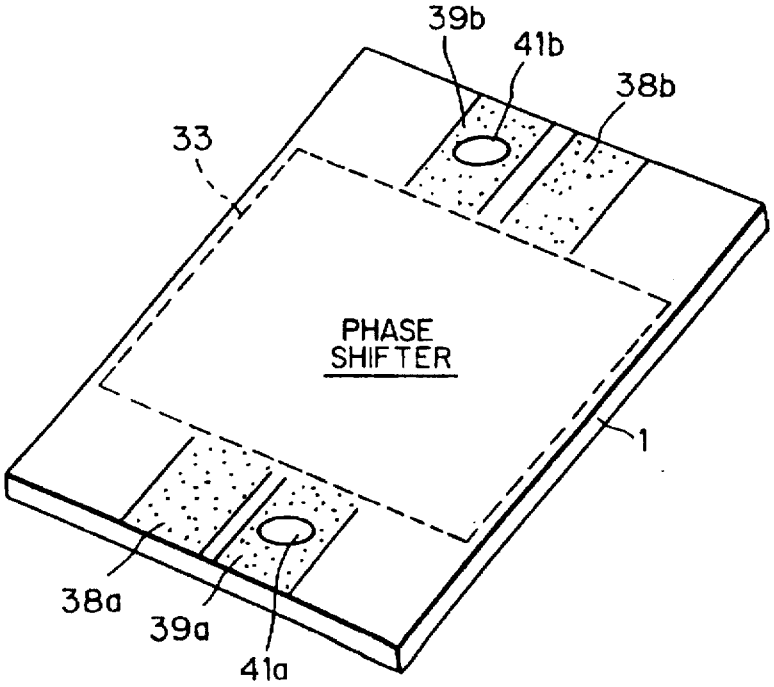
FIGS. 19 and 20 illustrate elevation and bottom views of the structure of the eleventh embodiment of a phase shifter according to the present invention.
Figure 20:
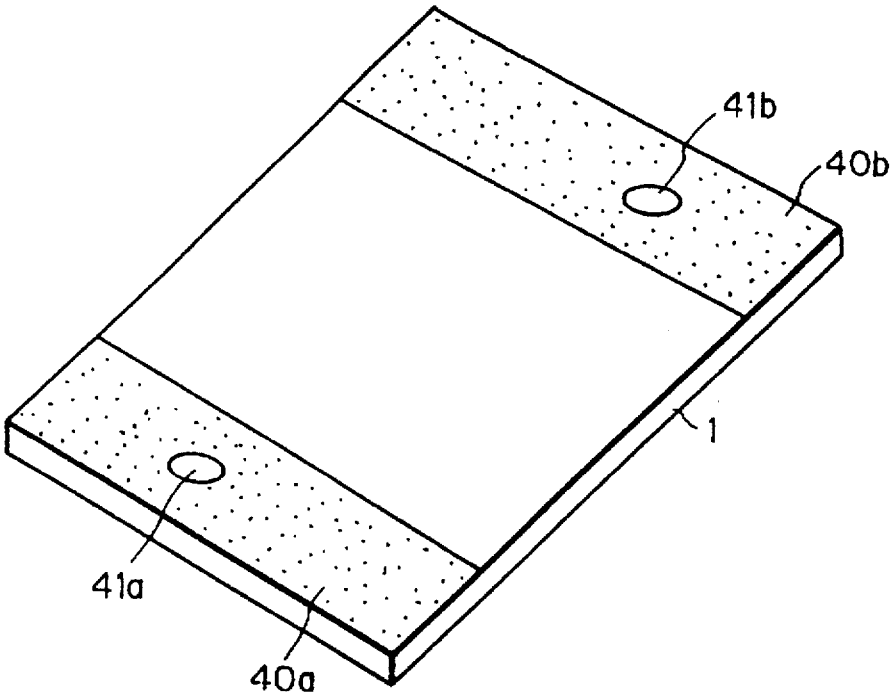
Figure 21:
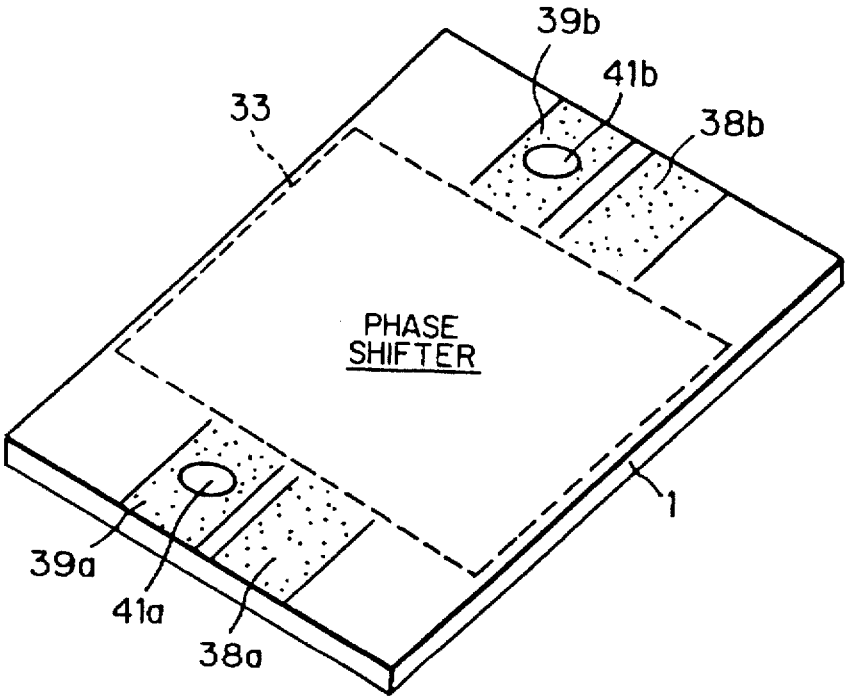
FIGS. 21 and 22 illustrate elevation and bottom views of a modification to the phase shifter of FIG. 19.
Figure 22:
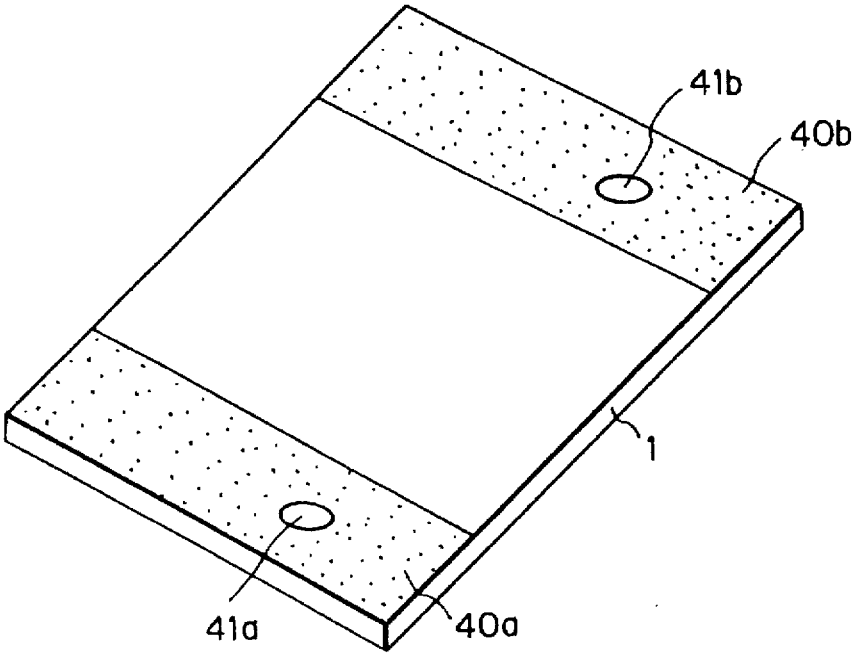

Elevation and bottom views of a phase shifter of the eleventh embodiment according to the present invention are respectively shown in FIGS. 19 and 20. In these figures, the reference numerals 38*a* and 38*b* define input/output microstrip line patterns; 39*a* and 39*b* ground patterns; 40*a* and 40*b* ground patterns formed on the rear surface of semiconductor substrate 1; 41*a* and 41*b* via holes for interconnecting ground patterns 39*a* and 49*b* and ground patterns 40*a* and 40*b*. One of input/output slot line patterns 2*a* is connected to input/output microstrip line pattern 38*a*, while the other of input/output slot line patterns 2*a* is connected to ground pattern 40*a* through ground pattern 39*a* and via hole 41*a*. In the same manner, one of line patterns 2*b* is connected to line pattern 38*b*, while the other of line patterns 2*b* to ground pattern 40*b* through ground pattern 39*b* and via hole 41*b*. This enables the type of input/output line to be converted from the slot line to the microstrip line, thereby facilitating the connection to other microwave integrated circuit which mainly utilizes microstrip lines. It is noted that similar advantages can be attained by interchanging input/output microstrip line pattern 38*a* and ground pattern 39*a* connected to input/output slot line pattern pair 2a, as illustrated in FIGS. 21 and 22.

Figure 23:
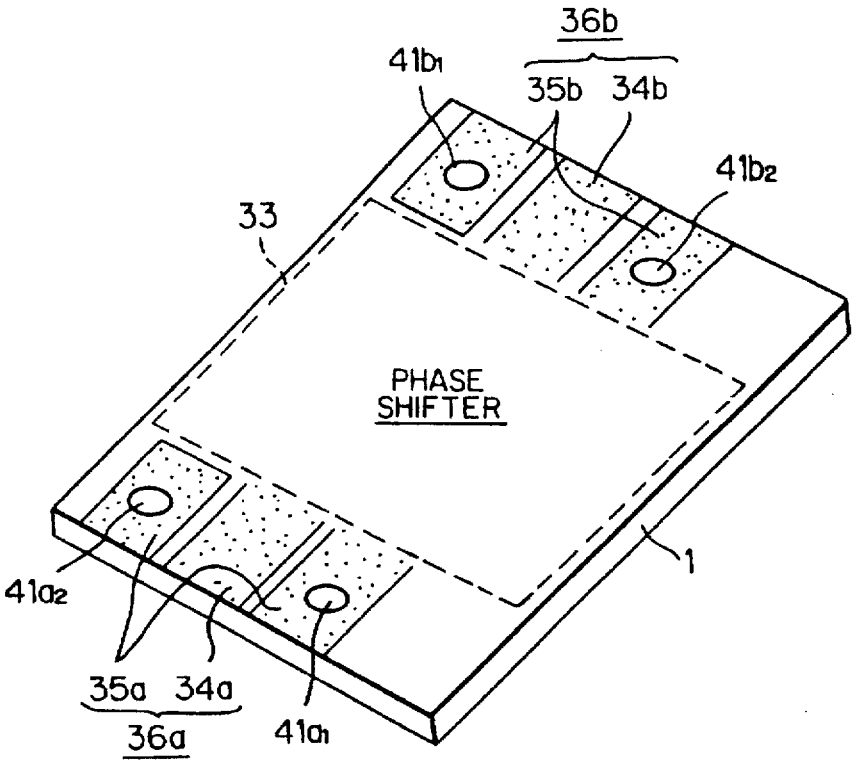
FIGS. 23 and 24 illustrate elevation and bottom views of the structure of the twelfth embodiment of a phase shifter according to the present invention.
Figure 24:
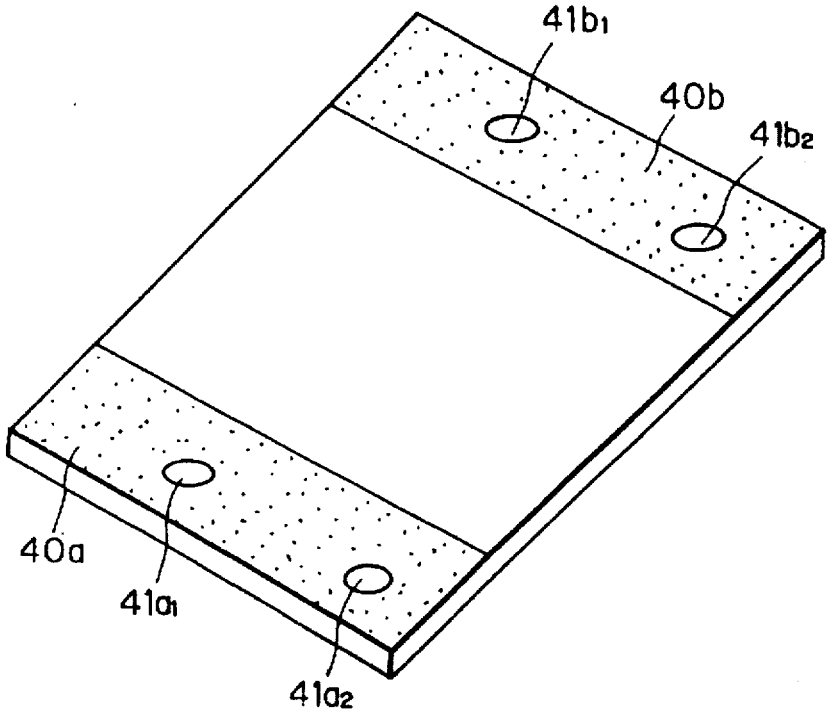
Figure 25:
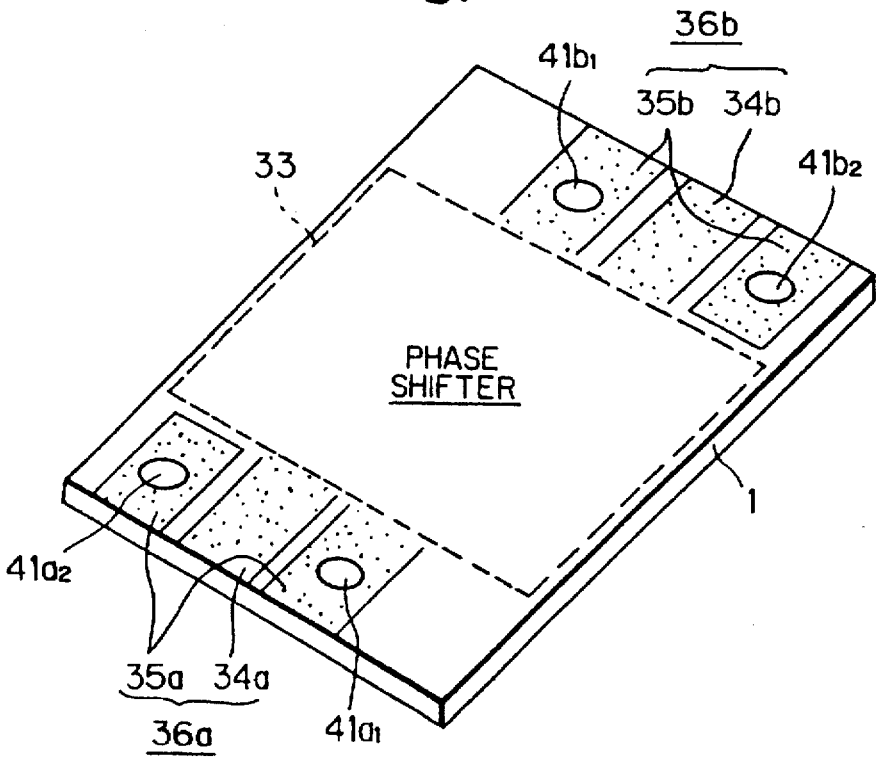
FIGS. 25 and 26 illustrate elevation and bottom views of a modification to the phase shifter of FIGS. 23 and 24.
Figure 26:
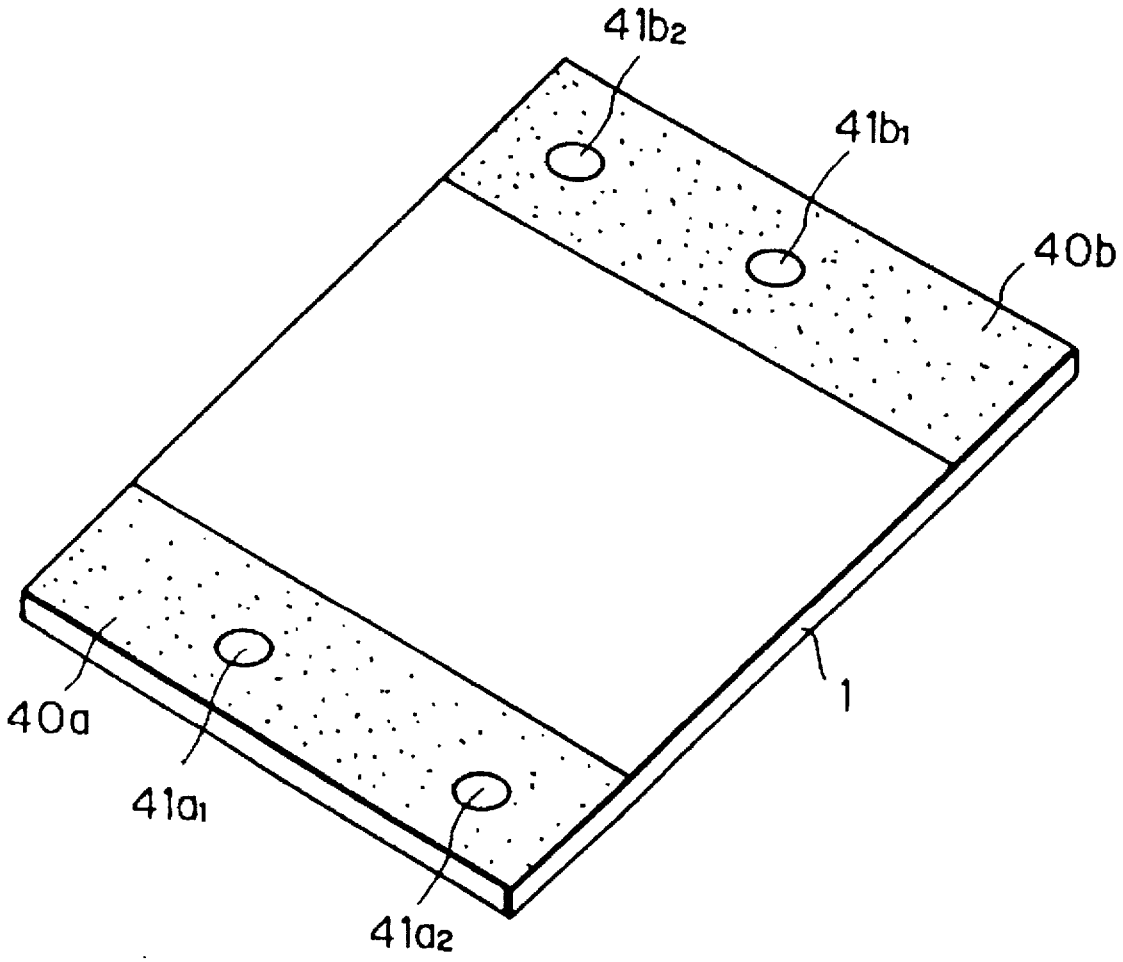

Elevation and bottom views of a phase shifter of the twelfth embodiment according to the present invention are respectively shown in FIGS. 23 and 24. The phase shifter of this embodiment has been proposed to modify the phase shifter shown in FIG. 17 in such a manner that ground patterns 40a, 40b formed on the rear surface opposite to input/output coplanar line patterns 36a, 36b which are connected to return pattern pairs 35a and 35b through via holes 41a1, 41a2, 41b1 and 41b2. Air bridges 37a and 37b may be eliminated. This enables signal line patterns 34a, 34b to be used as input/output microstrip line patterns 38a, 38b, and the phase shifter of the twelfth embodiment can exhibit advantages similar to those of the tenth and eleventh embodiments. It is noted that similar advantages can be brought about by modifying the arrangement illustrated in FIGS. 23 and 24, such as to connect one of return patterns 35b to one of input/output slot line patterns 2b as illustrated in FIGS. 25 and 26.

Figure 27:
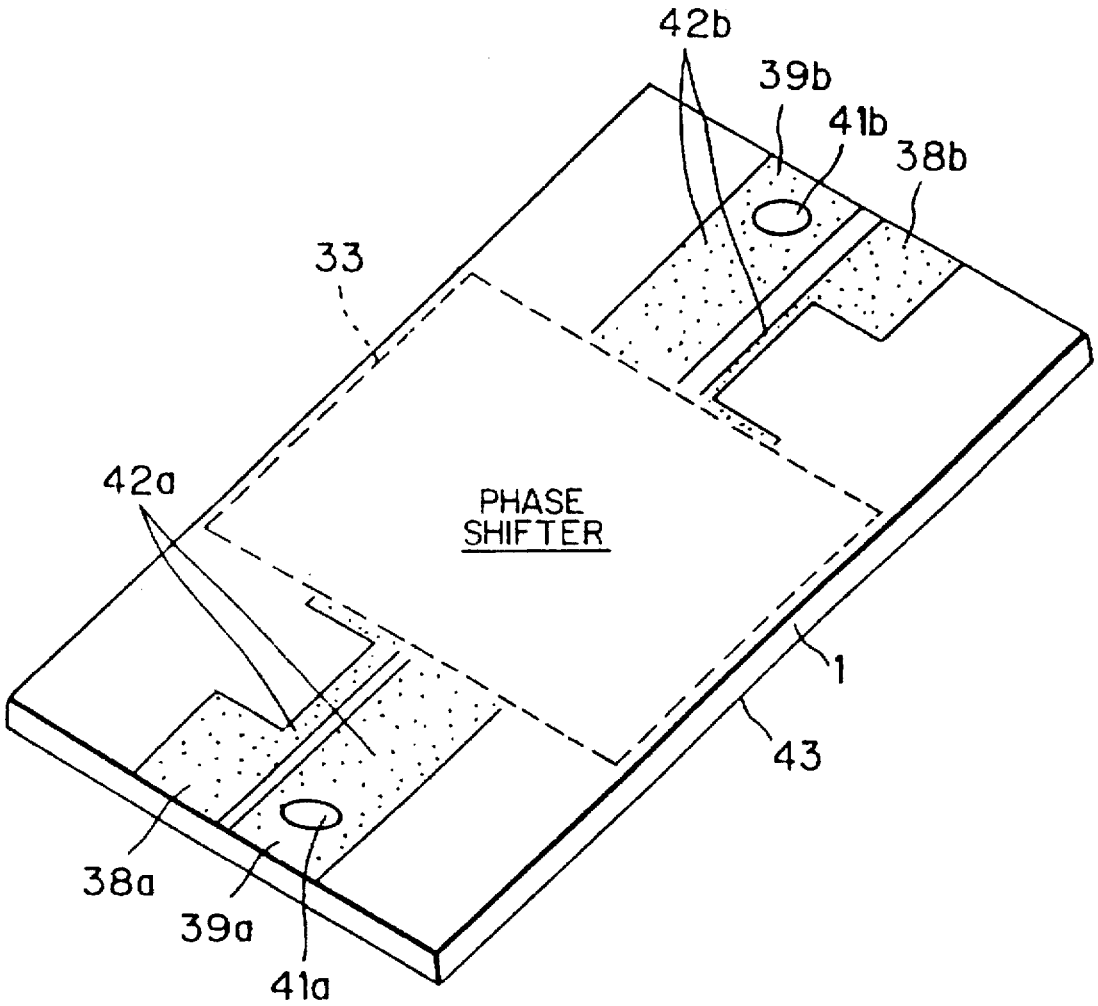
FIG. 27 illustrates a schematic view of the structure of the thirteenth embodiment of a phase shifter according to the present invention.

FIG. 27 illustrates the structure of the thirteenth embodiment of a phase shifter according to the present invention. In this figure, 42a to 42d define slot line pattern pairs; and 43 a ground pattern formed on the entire bottom surface of semiconductor substrate and connected to ground patterns 39a and 39b through via holes 41a and 41b. This embodiment is different from the structures illustrated in FIGS. 19 and 20 in that slot line pattern pairs 42a and 42b are arranged between input/output slot line pattern pairs 2a and 2b and input/output slot microstrip line patterns 38a and 38b, that ground pattern 43 is formed on the entire bottom surface of semiconductor substrate 1 in place of partial ground patterns 40a and 40b, and that one of slot line patterns 42a, 42b not connected to ground pattern 43 is formed sufficiently narrow so that there is substantially no capacitive coupling with ground pattern 43. Since the area between first slot line pattern pair 42a and second slot line pattern pair 42b has a small capacitive coupling with ground pattern 43 thereby avoiding any influence thereof, desired electrical characteristics can be obtained even if the ground pattern is formed on the entire bottom surface of semiconductor substrate 1, whereby the bottom surface of the phase shifter can be mounted by a soldering process or a conductive bonding agent. It is noted that such a structural modification as introduced in the thirteenth embodiment can also be applied to the structure illustrated in FIGS. 21 and 22 and similar advantages can be drawn.

Figure 28:
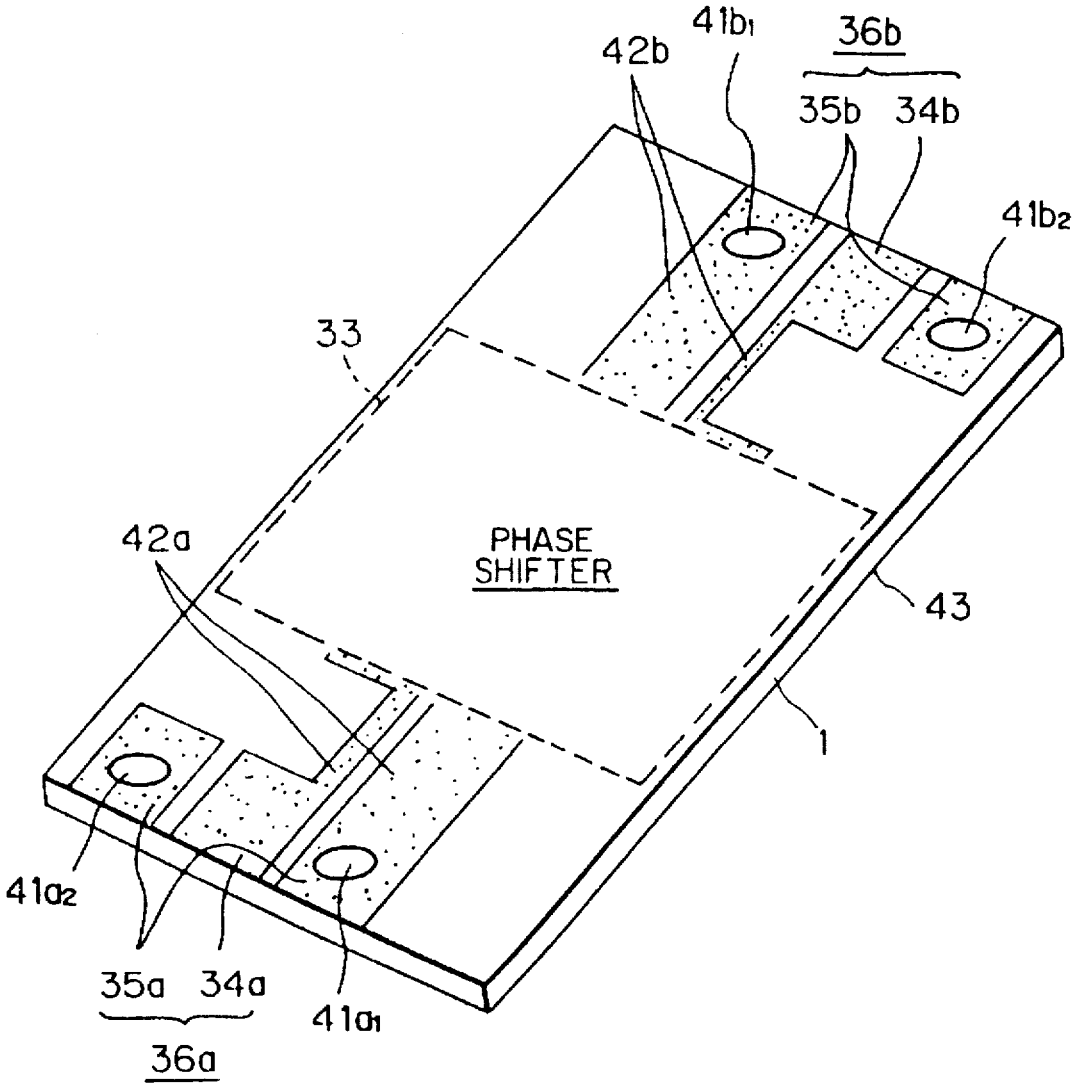
FIG. 28 illustrates a schematic view of the structure of the fourteenth embodiment of a phase shifter according to the present invention.

FIG. 28 illustrates the structure of the fourteenth embodiment of a phase shifter according to the present invention. This embodiment is different from the structure illustrated in FIGS. 23 and 24 in that slot line pattern pairs 42a and 42b are arranged between input/output slot line pattern pairs 2a and 2b and input/output coplanar line patterns 36a and 36b, that ground patterns 40a and 40b are replaced with ground pattern 43 formed on the entire bottom surface of substrate 1 and that one of slot line patterns 42a and 42b not connected to ground pattern 43 is formed sufficiently narrower so that there is substantially no capacitive coupling with ground pattern pairs 42a, 42b. Since the area between first slot line pattern pair 42a and second slot line pattern pair 42b has a small capacitive coupling with ground pattern 43 thereby avoiding any influence thereof, desired electrical characteristics can be obtained even if the ground pattern is formed on the entire bottom surface of semiconductor substrate 1, whereby the bottom surface of the phase shifter of the present invention can be mounted by a soldering process or a conductive bonding agent. In addition, a microwave on-wafer test can be made by using an on-wafer prober in which coplanar lines are mainly utilized. The structural modification introduced in the fourteenth embodiment can be applied to the structure illustrated in FIGS. 25 and 26 and similar advantages can be drawn.

Figure 29:
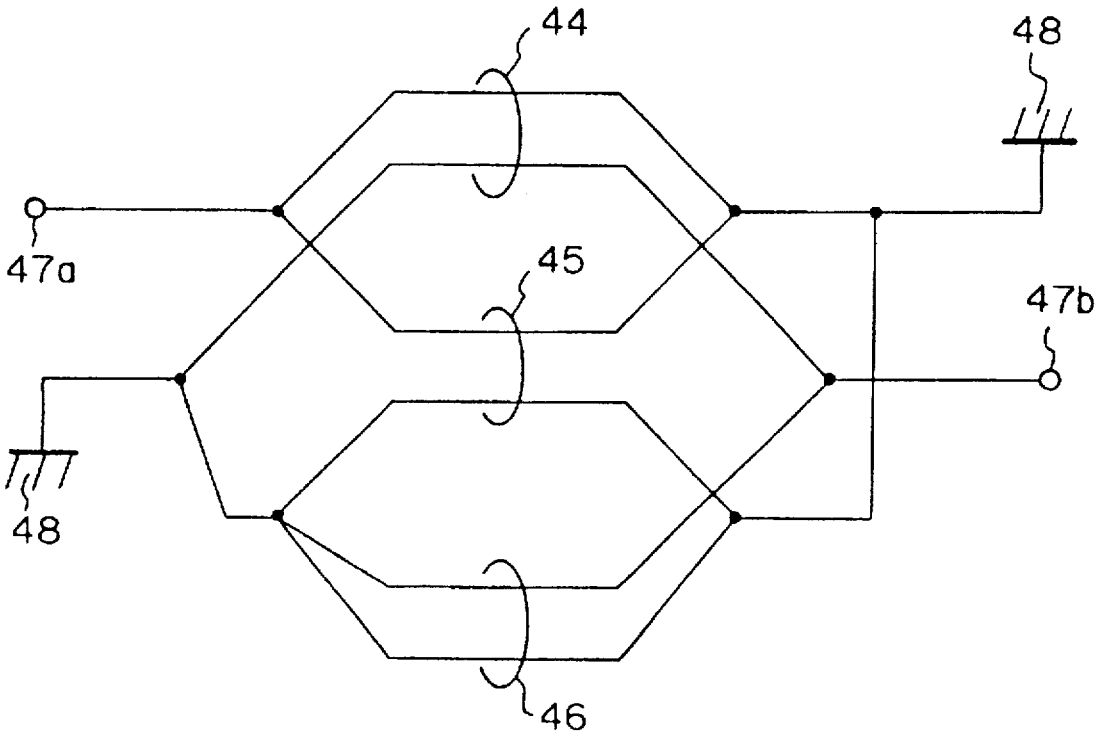
FIGS. 29 to 32 are diagrams for explaining operations of the phase shifter illustrated in FIGS. 27 and 28.
Figure 30:
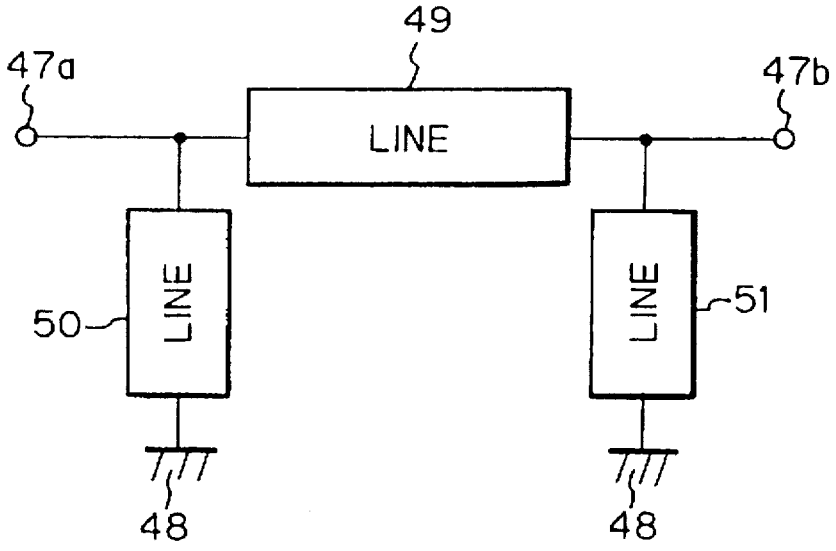
Figure 31:
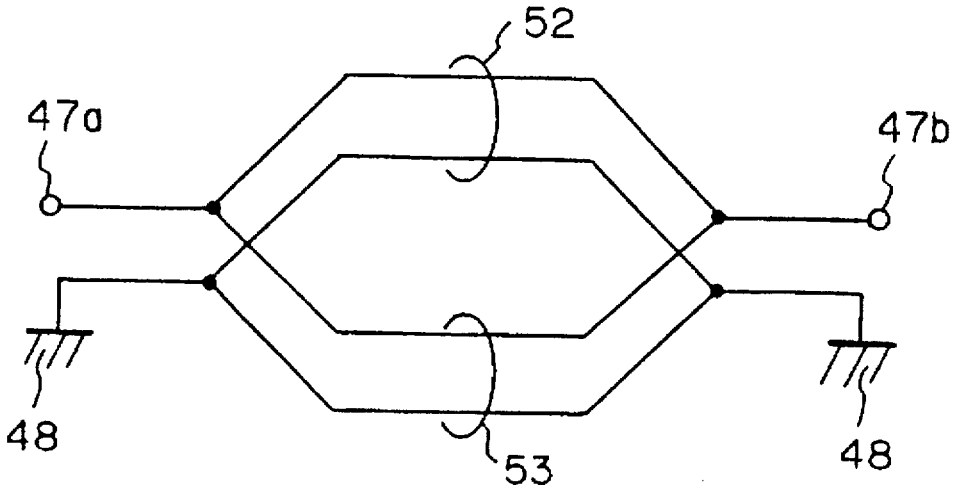
Figure 32:
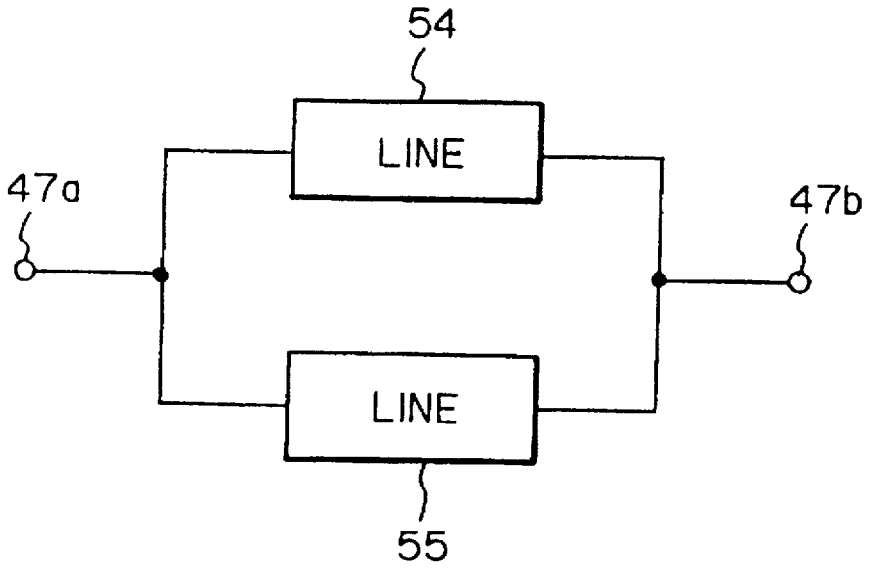

FIGS. 29 and 31 are diagrams for explaining the operations of the phase shifters illustrated in FIGS. 27 and 28, while FIGS. 30 and 32 respectively show equivalent circuits thereof. In these figures, the reference numeral 44 designates a slot line formed by first slot line pattern pair 42a and second slot line pattern pair 42b when first and second FETs 6a and 6b (FIGS. 27 and 28) are ON and third and fourth FETs 6c and 6d are OFF; 45 a microstrip line comprising the microstrip line formed by the narrower pattern of first slot line pattern pair 42a and ground pattern 43 and the microstrip line formed by the wider pattern of second slot line pattern pair 42b and ground pattern 43; 46 a microstrip line comprising the microstrip line formed by the wider pattern of first slot line pattern pair 42a and ground pattern 43 and the microstrip line formed by the narrower pattern of second slot line pattern pair 42b and ground pattern 43; 47a and 47b input/output terminals; 48 a ground level; 49 a line corresponding to slot line 44; 50 a line corresponding to microstrip line 45; 51 a line corresponding to microstrip line 46; 52 a slot line formed by first slot line pattern pair 42a and second slot line pattern pair 42b when first and second FETs 6a and 6b (FIGS. 27 and 28) are OFF and third and fourth FETs 6c and 6d are ON; 53 a microstrip line comprising the microstrip line formed by the narrower pattern of first slot line pattern pair 42a and ground pattern 43 and the microstrip line formed by the narrower pattern of second slot line pattern pair 42b and ground pattern 43; 54 a line corresponding to slot line 52; and 55 a line corresponding to microstrip line 53. Resistances of first to fourth FETs 6a to 6d when they are ON are eliminated for simplicity's sake.

In operation, when first and second FETs 6a and 6b are ON and third and fourth FETs 6c and 6d are OFF, microstrip lines 45 and 46 formed by slot line pattern pairs 42a and 42b and ground pattern 43 are considered to be equivalent to lines 50 and 51 one end of which is connected to ground pattern 48 as illustrated in FIG. 30. Meanwhile, when first and second FETs 6a and 6b re OFF and third and fourth FETs 6c, 6d are ON, microstrip line 53 formed by slot line pattern pairs 42a and 42b and ground pattern 43 is considered to be equivalent to line 55 parallel to line 54 as illustrated in FIG. 32. Since one of slot line patterns 42a and 42b is the narrower pattern, line 50, 51 and 55 are respectively high-impedance lines whereby the influence thereof can be reduced. If the electrical lengths of these lines are too short, since input/output terminals 47a and 47b can be considered to be substantially short-circuited typically in FIG. 30, the VSWR between the input and output terminals remarkably deteriorates. The VSWR can be improved by setting the length of lines 50 and 51 to one quarter of the wavelength of the operating frequency.

Figure 33:
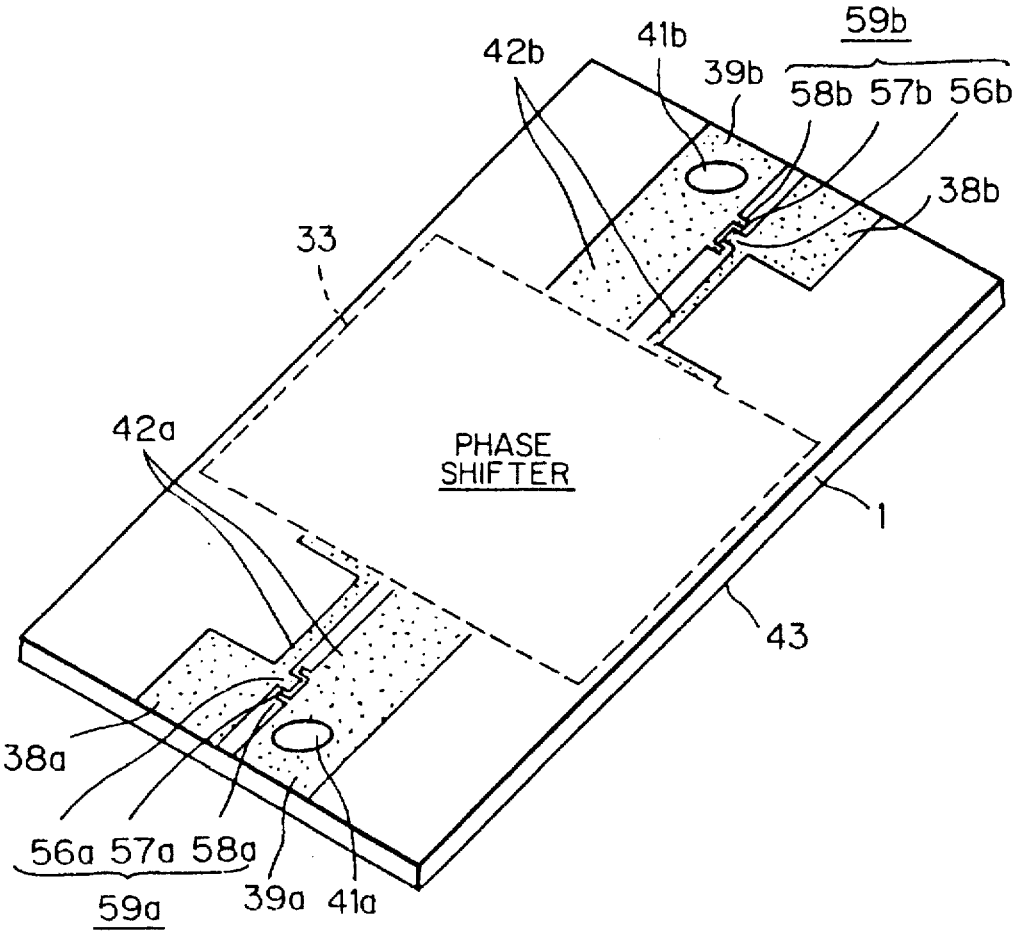
FIG. 33 illustrates a schematic view of the structure of the fifteenth embodiment of a phase shifter according to the present invention.
Figure 34:
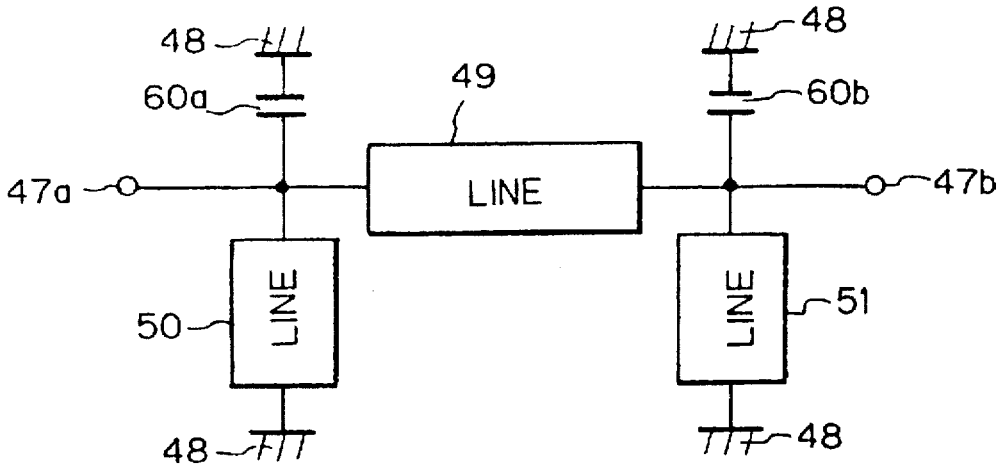
FIG. 34 is a diagram for explaining operations of the phase shifter illustrated in FIG. 33.

FIG. 33 illustrates the structure of the fifteenth embodiment of a phase shifter according to the present invention. FIG. 34 is a diagram for explaining operations of the phase shifter of the fifteenth embodiment. In these figures, the reference numeral 56a and 56b define upper electrodes of parallel-plate capacitors 59a and 59b; 57a and 57b dielectric materials; 58a and 58b the lower electrodes of parallel-plate capacitors; 59a and 59b, and 60a and 60b, capacitors.

In operation, when first and second FETs 6a and 6b are ON and third and fourth FETs 6c and 6d are OFF, lines 50 and 51 connected to ground pattern 48 (FIG. 34) are considered to correspond to the microstrip line formed by slot line pattern pair 42a and 42b and ground pattern 43. Capacitors 60a and 60b (FIG. 34) correspond to parallel-plate capacitors 59a and 59b. It is noted that any deterioration in VSWR due to the existence of lines 50 and 51 can be avoided by obtaining a capacitance $C_1$ of capacitor 60a and a shunt inductance $L_1$ formed by line 50 and ground pattern 48 from the formula $f=\frac{1}{2\pi L_1 C_1}$ making a parallel resonance at a predetermined frequency and by obtaining a capacitance $C_2$ of capacitor 60b and a shunt inductance $L_2$ formed by line 51 and ground pattern 48 from the formula $f=\frac{1}{2\pi L_2 C_2}$ making a parallel resonance at a predetermined frequency. In this embodiment, a parallel-plate capacitor is used, but similar advantages can be brought about by utilizing an inter-digital capacitor in such a case that a small capacitance value is required.

Figure 35:
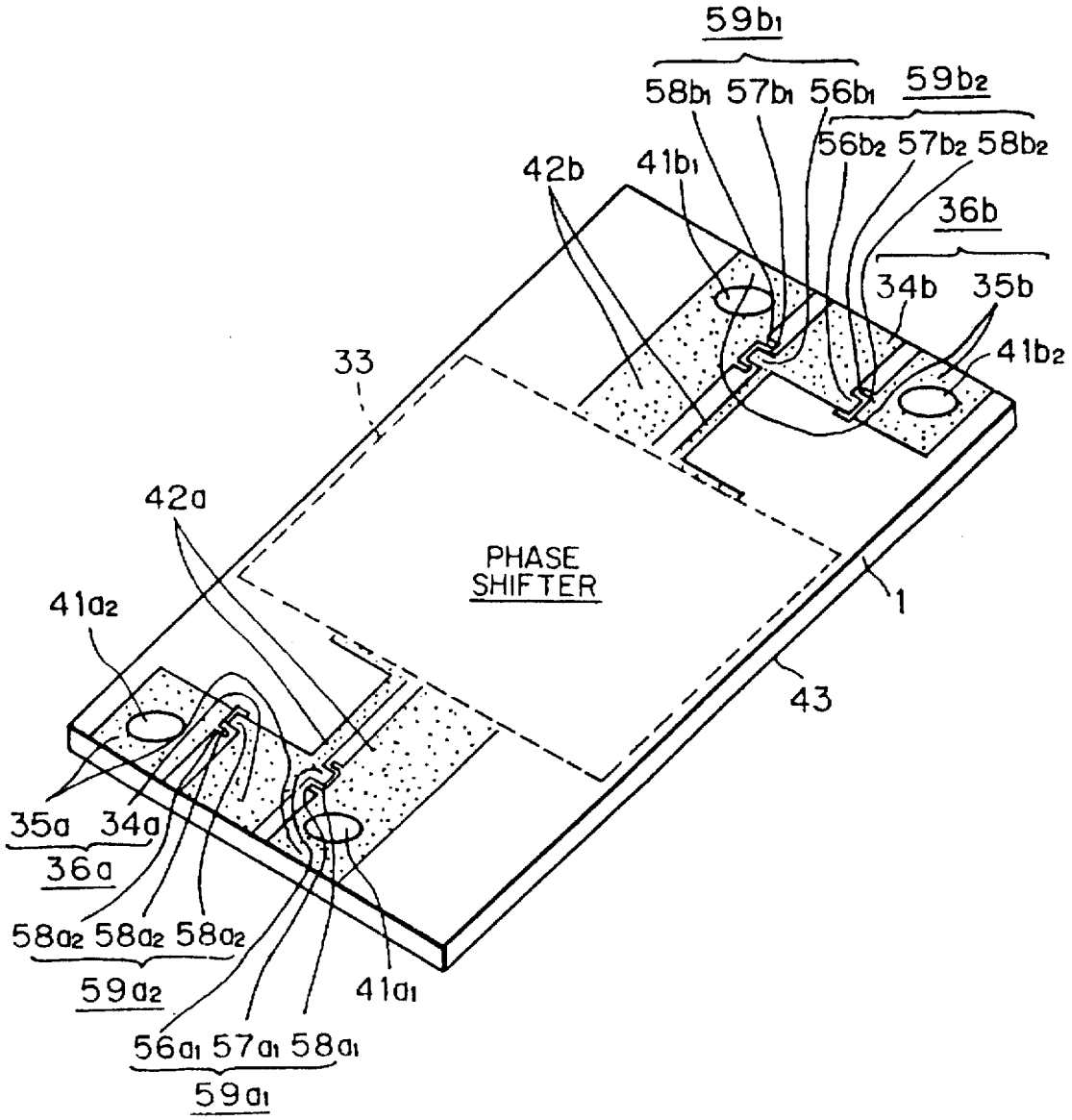
FIG. 35 illustrates a schematic view of the structure of the sixteenth embodiment of a phase shifter according to the present invention.

FIG. 35 illustrates the structure of the sixteenth embodiment of a phase shifter according to the present invention. In FIG. 35, a capacitor constituted by parallel-plate capacitors 59a1 and 59a2 corresponds to capacitor 60a in FIG. 34, while a capacitor constituted by parallel-plate capacitors 59b1 and 59b2 corresponds to capacitor 60b in FIG. 34. Therefore, this embodiment operates on the same principle as the fifteenth embodiment and brings about similar advantages.

Figure 36:
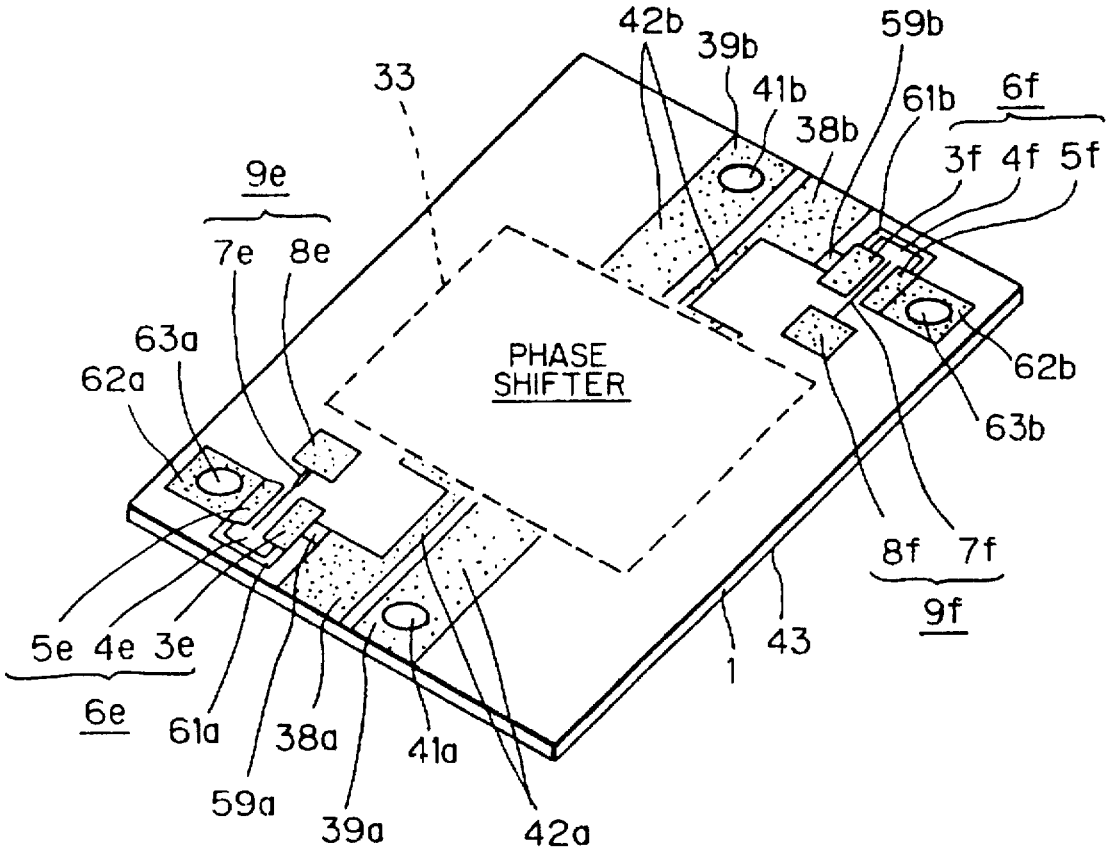
FIG. 36 illustrates a schematic view of the structure of the seventeenth embodiment of a phase shifter according to the present invention.
Figure 37:
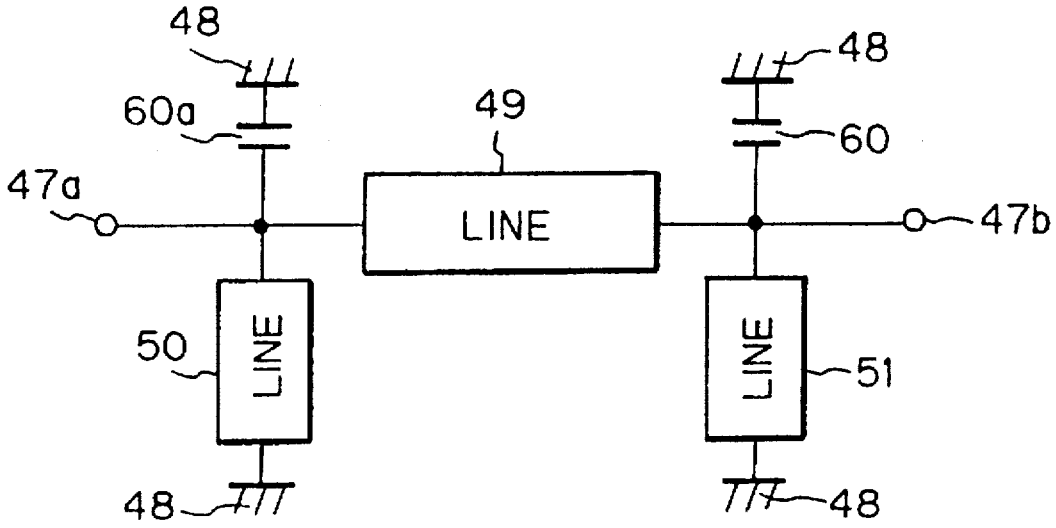
FIGS. 37 and 38 are diagrams for explaining operations of the phase shifter illustrated in FIG. 36.
Figure 38:
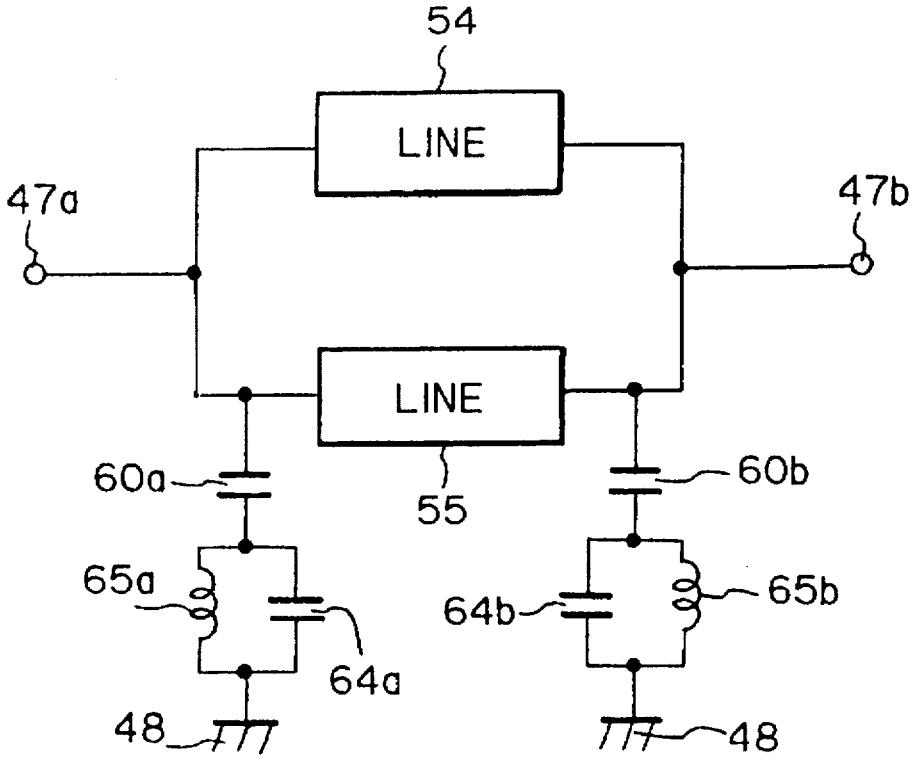

FIG. 36 illustrates the structure of the seventeenth embodiment of a phase shifter according to the present invention, while FIGS. 37 and 38 are diagrams for explaining operations of the same. In these figures, the reference numerals 61a and 61b respectively define inductor patterns loaded between drain electrodes 3e and 3f and source electrodes 5e and 5f of fifth FET 6e and sixth FET 6f; 62a and 62b, ground patterns; 63a and 63b, via holes; 64a and 64b drain-source capacitors when FETs 6e and 6f are OFF; and 65a and 65b inductors of inductor patterns 61a and 61b, respectively.

Operations will then be explained hereunder. FIG. 37 is a diagram for explaining the operations when first and second FETs 6a and 6b are ON, third and fourth FETs 6c and 6d are OFF and fifth and sixth FETs 6e and 6f are ON. In this case, any deterioration in VSWR due to the existence of lines 50 and 51 can be suppressed by selecting the capacitance of capacitor 60a and the shunt inductance formed by line 50 and ground 48 to make a parallel resonance in an operating frequency band and by selecting the capacitance of capacitor 60b and a shunt inductance formed by line 51 and ground pattern 48 to effect a parallel resonance in the operating frequency band.

FIG. 38 is a diagram for explaining operations when first and second FETs 6a and 6b are OFF, third and fourth FETs 6c and 6d are ON and fifth and sixth FETs 6e and 6f are OFF. In this case, the capacitors 60a and 60b can be neglected and any deterioration in VSWR due to capacitors 60a and 60b can be suppressed by selecting the capacitances of capacitors 64a and 64b and inductances of inductors 65a and 65b to make a parallel resonance in the operating frequency band.

Figure 39:
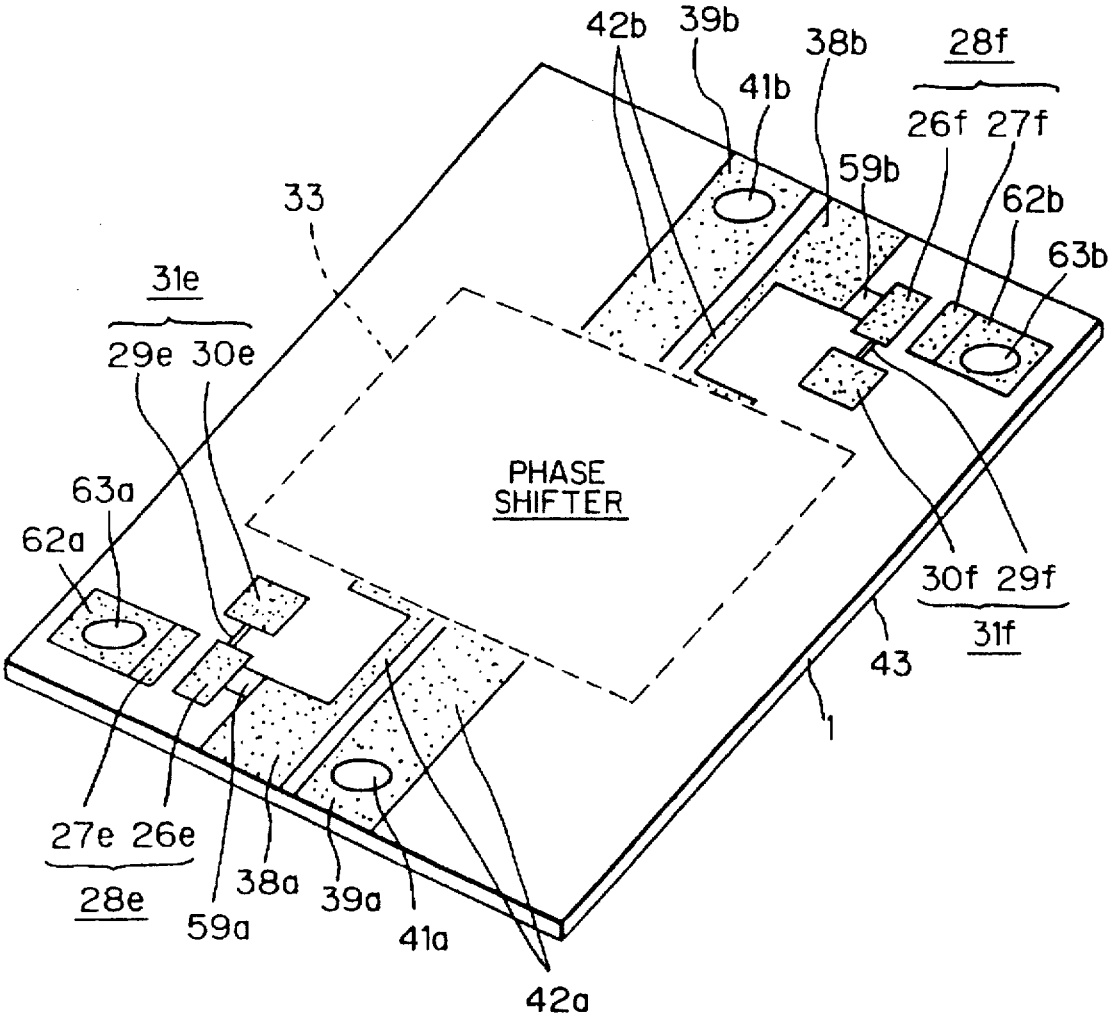
FIG. 39 illustrates a schematic view of the structure of the eighteenth embodiment of a phase shifter according to the present invention.
Figure 40:
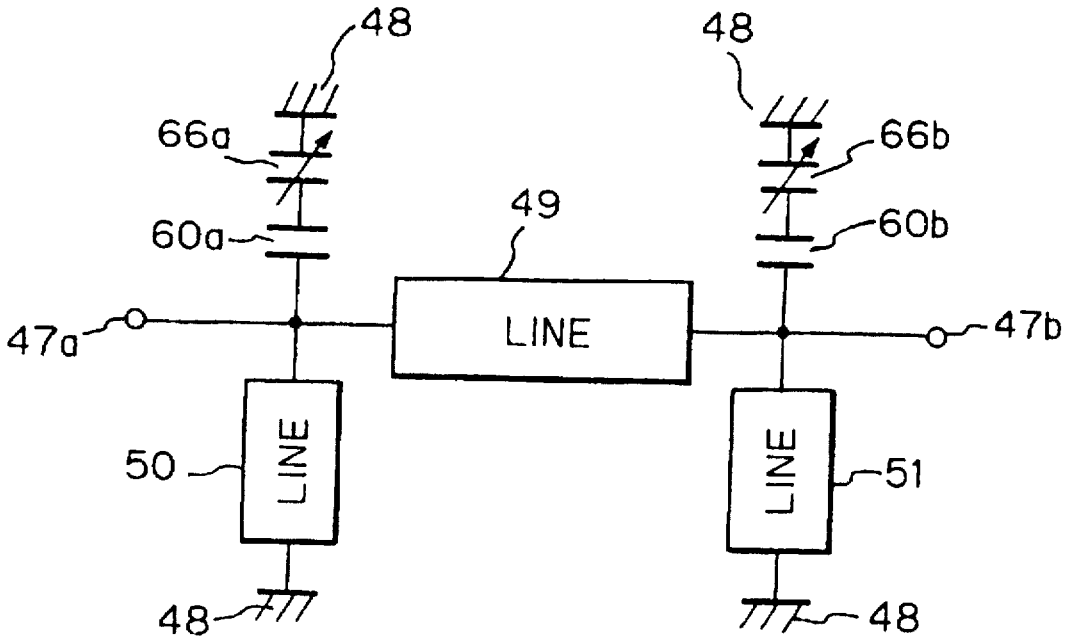
FIGS. 40 and 41 are diagrams for explaining operations of the phase shifter illustrated in FIG. 39.
Figure 41:
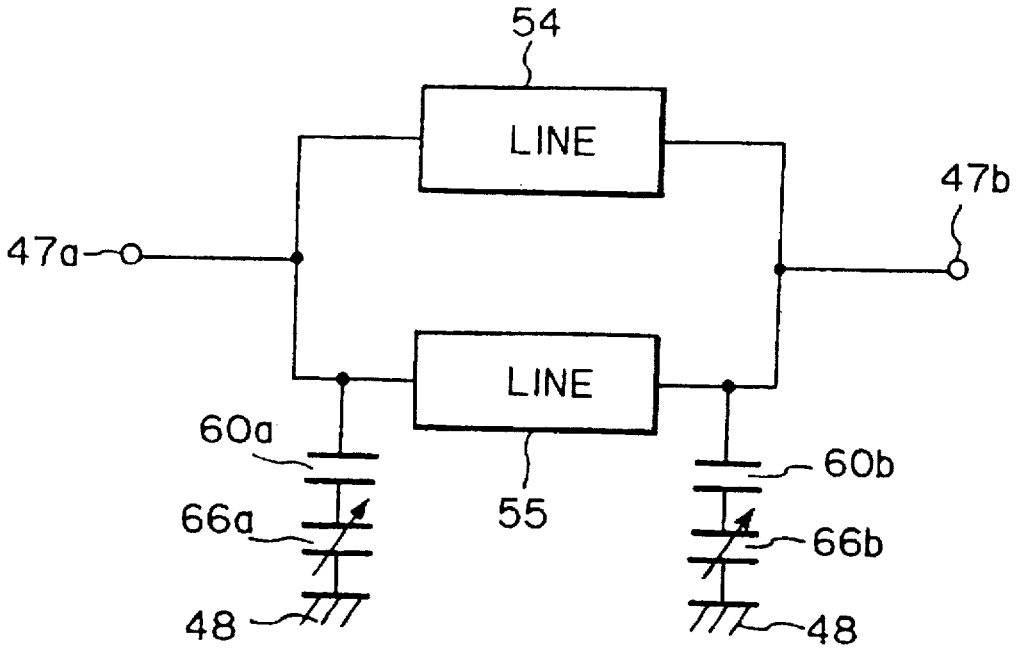

FIG. 39 illustrates the structure of the eighteenth embodiment of a phase shifter according to the present invention and FIGS. 40 and 41 are diagrams for explaining operations of the same. In these figures, the reference numerals 66a and 66b define variable capacitors which are formed between anodes 26e and 26f and cathodes 27e and 27f of fifth and sixth diodes 28e and 28f and are varied in accordance with the bias voltages applied thereto.

Operations of the phase shifter will be explained. FIG. 40 is a diagram for explaining operations when first and second FETs 6a and 6b are ON, third and fourth FETs 6c and 6d are OFF and the capacitances between the anodes and cathodes of fifth and sixth diodes 28e and 28f are at a maximum (when, for example, the voltage across the anode and the cathode is 0 V). In this case, any deterioration in VSWR due to lines 50 and 51 can be suppressed and advantages similar to those of the seventeenth embodiment can be achieved by selecting the total capacitances of capacitor 60a and variable capacitor 66a and a shunt inductance formed by line 50 and ground pattern 48 to make a parallel resonance in an operating frequency band and by selecting the total capacitances of capacitor 60b and variable capacitor 66b and the shunt inductance formed by line 51 and ground pattern 48 to make a parallel resonance in the operating frequency band.

FIG. 41 is a diagram for explaining operations when first and second FETs 6a and 6b are OFF, third and fourth FETs 6c and 6d are ON and the capacitances between the anodes and cathodes of fifth and sixth diodes 28e and 28f are at a minimum (when, for example, an inverse bias which is close to the breakdown voltage is applied across the anode and the cathode). Since the capacitances of variable capacitors 66a and 66b can be made smaller, the total capacitances of capacitors 60a and 60b and variable capacitors 66a and 66b can also be made smaller. Accordingly, any deterioration in VSWR due to capacitors 60a and 60b can be suppressed and advantages similar to those of the seventeenth embodiment can be achieved.

Figure 42:
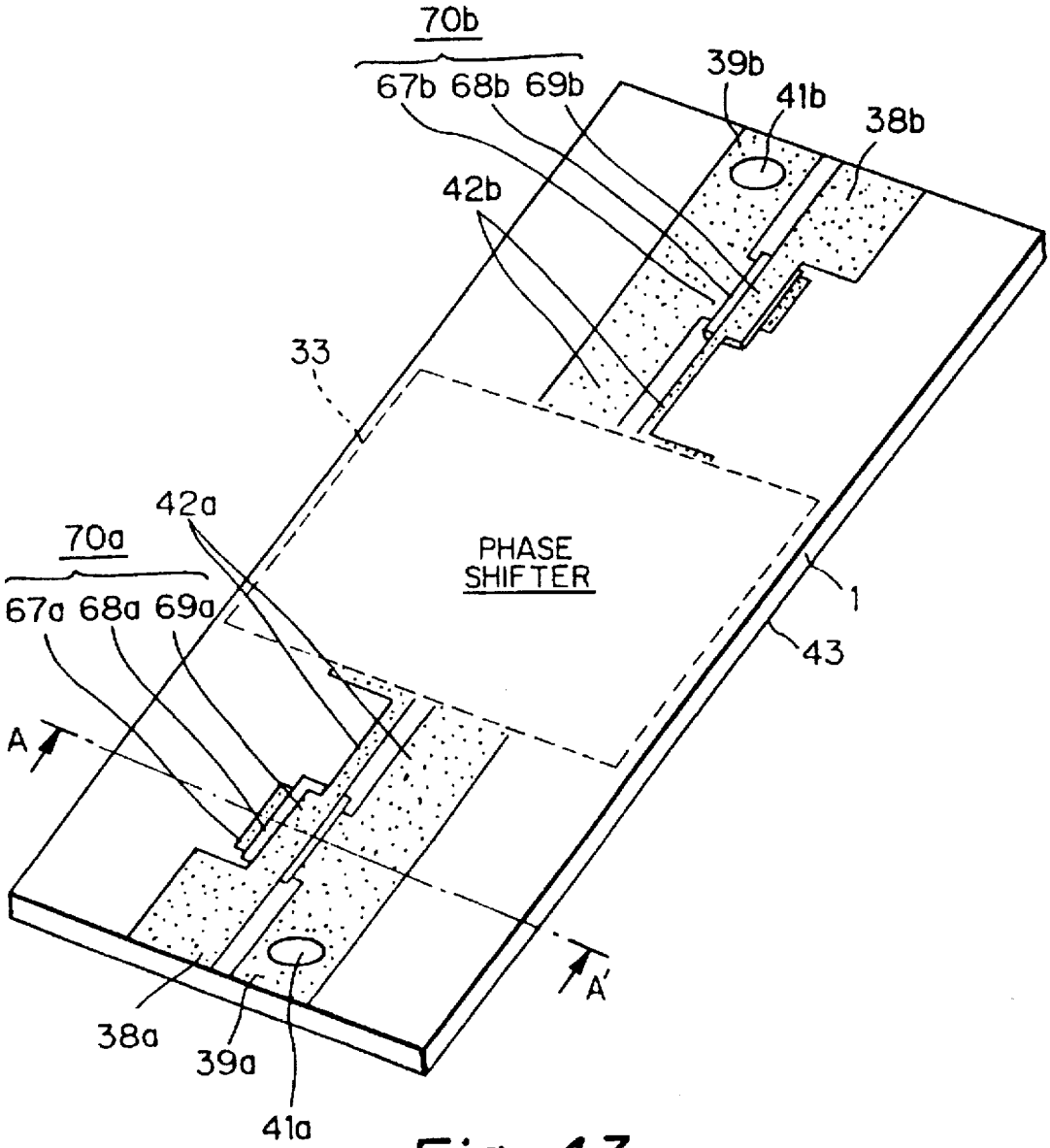
FIG. 42 illustrates a schematic view of the structure of the nineteenth embodiment of a phase shifter according to the present invention.
Figure 43:
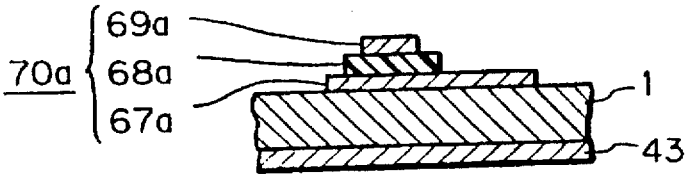
FIG. 43 is a cross-sectional view taken along the line A—A of FIG. 42.

FIG. 42 illustrates the structure of the nineteenth embodiment of a phase shifter according to the present invention and FIG. 43 illustrates a cross section of the phase shifter taken along the line A—A in FIG. 42. In the figures, the reference numerals 67a and 67b define ground patterns; 68a and 68b dielectric materials; 69a and 69b microstrip line patterns; and 70a and 70b microstrip lines formed by ground patterns 67a and 67b, dielectric materials 68a and 68b and microstrip line patterns 69a and 69b. This embodiment is constituted by modifying the structure shown in FIG. 27 in such a manner that microstrip lines 70a, 70b are disposed between input/output microstrip line patterns 38a and 38b and slot line pattern pairs 42a and 42b and that ground patterns 67a and 67b of microstrip lines 70a and 70b are connected to microstrip line patterns 69a and 69b as illustrated in FIG. 42.

In any of the microstrip lines, coplanar lines or slot lines, an AC signal generally propagates as an electro-magnetic wave between a couple of conductors (signal pattern and ground pattern). If the phase shifter illustrated in FIG. 42 is connected to a microstrip line, an input signal first propagates through a transmission line comprising ground pattern 43 and input/output microstrip line patterns 38a and 38b. In order that the signal propagates with a low loss to slot line pairs 42a and 42b, a total return current has to flow from ground pattern 43 through via holes 41a, 41b to the upper side of the semiconductor substrate. Since ground pattern 43 exists below slot line pattern pairs 42a and 42b, a microstrip line is formed by signal patterns of slot line pattern pairs 42a and 42b and ground pattern 43. Consequently, a part of the return current also flows through ground pattern 43 at the portions opposite to slot line pattern pairs 42a and 42b. The provision of ground patterns 67a and 67b between microstrip line patterns 69a, 69b and ground pattern 43 as illustrated in FIG. 43 effectively reduces any capacitive coupling between microstrip line patterns 69a and 69b and ground pattern 43, prevents the return current from flowing through the portions of ground pattern 43 opposite slot line pattern pairs 42a and 42b and further reduces any influence of ground pattern 43 between first microstrip line 70a and second microstrip line 70b.

Figure 44:
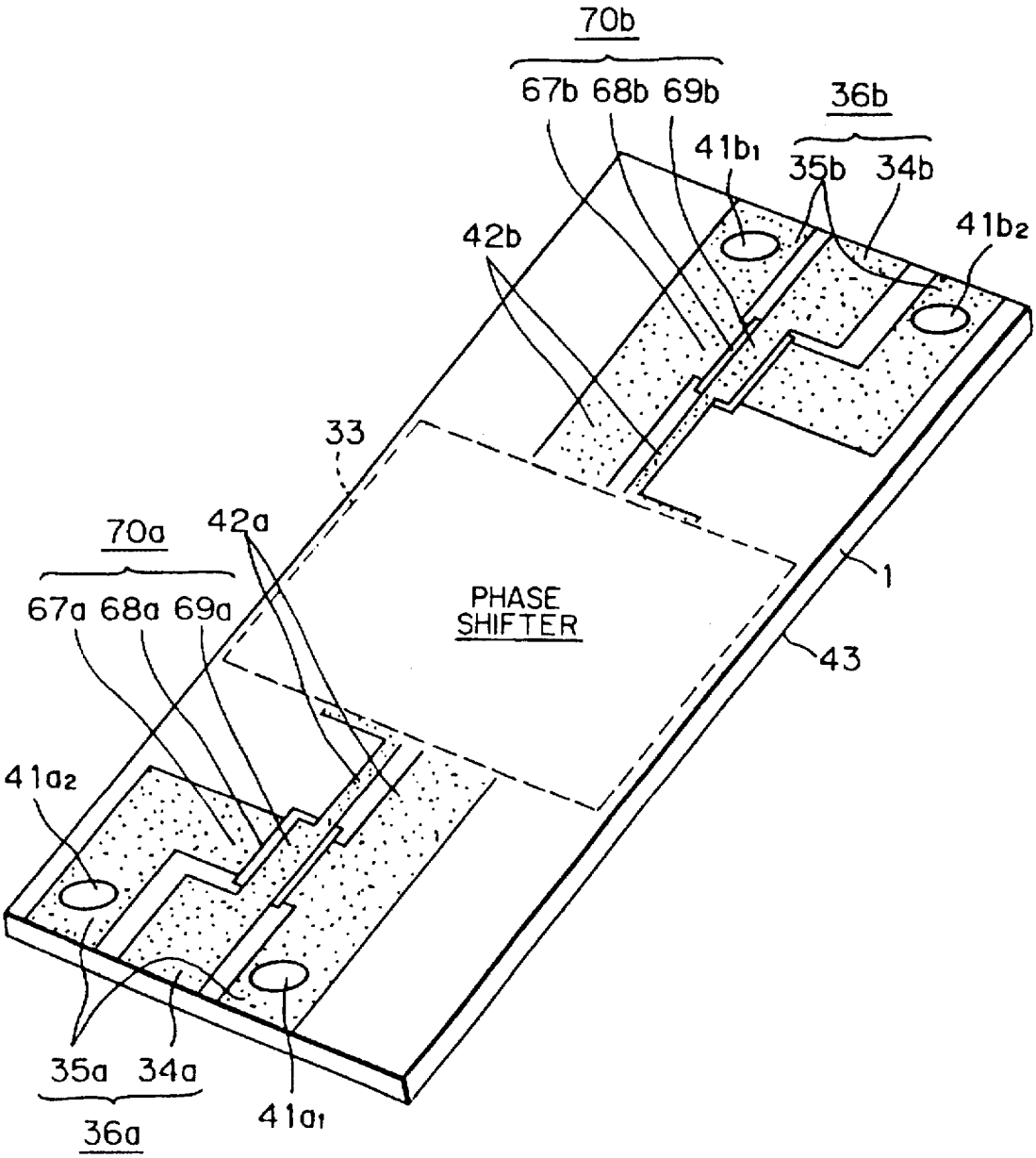
FIG. 44 illustrates a schematic view of the structure of the twentieth embodiment of a phase shifter depending on an embodiment 20 of the present invention.

FIG. 44 illustrates the structure of the twentieth embodiment of a phase shifter according to the present invention. This structure is constituted by modifying the structure shown in FIG. 28 in such a manner that microstrip lines 70a and 70b are disposed between input/output coplanar line patterns 36a and 36b and slot line pattern pairs 42a and 42b and that ground patterns 67a and 67b of microstrip lines 70a and 70b are connected to microstrip line patterns 69a and 69b as illustrated in FIG. 42. As a result, advantages similar to those of the nineteenth embodiment can be derived.

Figure 45:
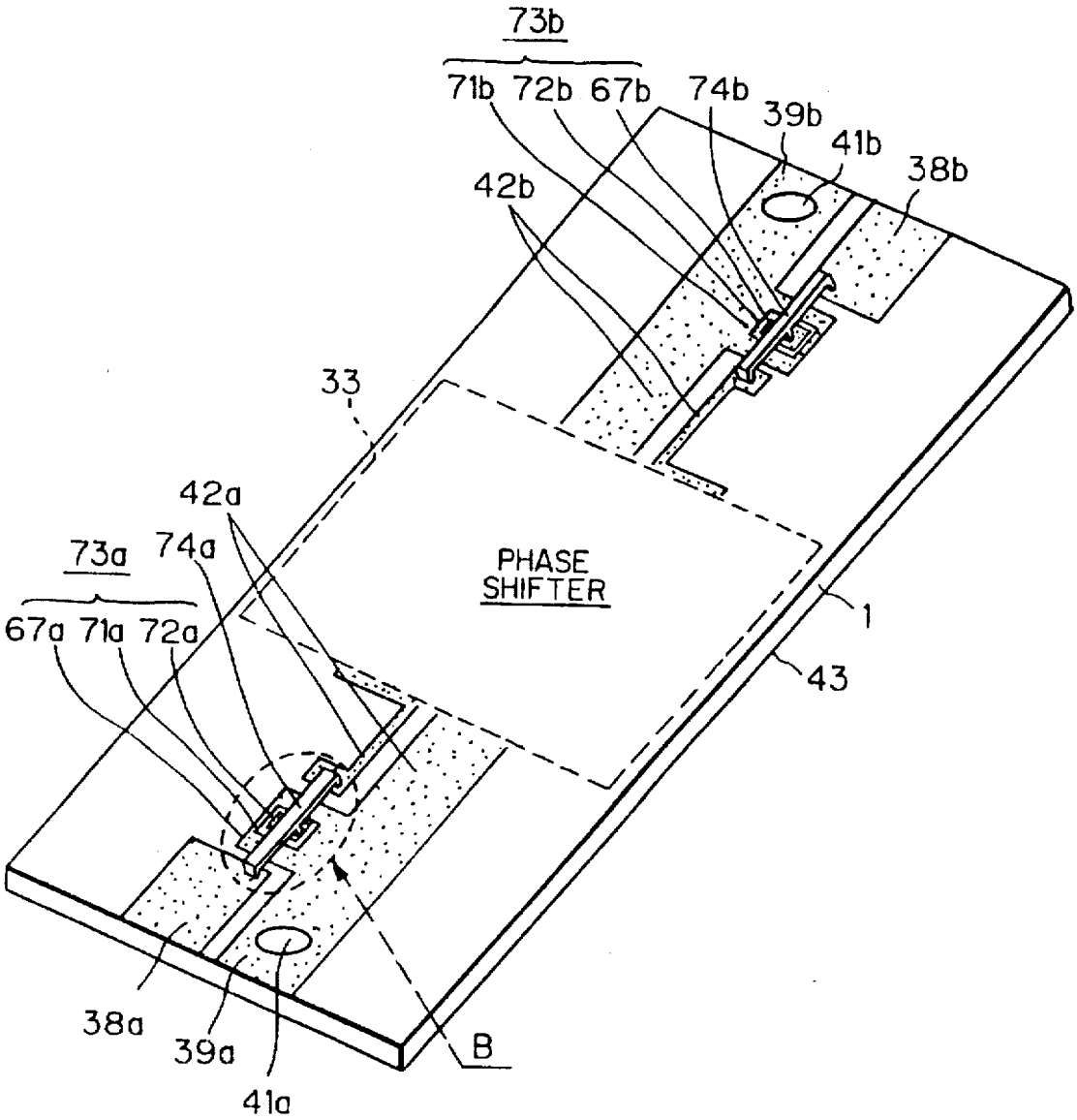
FIG. 45 illustrates a schematic view of the structure of the twenty-first embodiment of a phase shifter according to the present invention.
Figure 46:
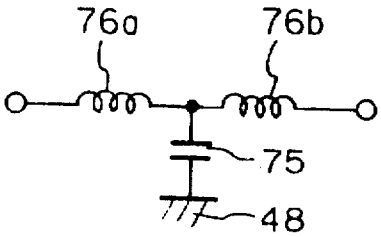
FIG. 46 is an equivalent circuit of the portion B illustrated in FIG. 45.

FIG. 45 illustrates the structure of the twenty-first embodiment of a phase shifter according to the present invention and FIG. 46 shows an equivalent circuit of part B surrounded by a broken line in FIG. 45. In the figures, the reference numerals 71a and 71b define dielectric materials; 72a and 72b upper electrodes formed on dielectric materials 71a and 71b; 73a and 73b parallel-plate capacitors formed by ground patterns 67a and 67b, dielectric materials 71a and 71b and upper electrodes 72a and 72b; 74a and 74b air bridges connecting input/output microstrip line patterns 38a and 38b, upper electrodes 72a and 72b and the narrower patterns of the slot line pattern pairs 42a and 42b; 75 a capacitor corresponding to parallel-plate capacitor 73a; and 76a and 76b inductors corresponding to air bridges 74a and 74b.

In the embodiment illustrated in FIG. 42, microstrip lines 70a and 70b are disposed between input/output microstrip line patterns 38a and 38b and slot line pattern pairs 42a and 42b. If dielectric materials 68a and 68b are as thin as thousands of angstroms, the pattern width of the microstrip line patterns 69a and 69b must be externally narrow in order to obtain the predetermined characteristic impedance (for example, 50Ω), and such a narrow pattern is unachievable. The phase shifter illustrated in FIG. 45 has such a structure that small parallel-phase capacitors 73a, 73b are formed by ground patterns 67a, 67b, dielectric materials 71a, 71b and upper electrodes 72a, 72b and that connections are made by means of the air bridges. Therefore, part B surrounded by the broken line equivalently forms a T-shaped low-pass filter comprising capacitor 75 and inductors 76a and 76b as illustrated in FIG. 46 to achieve a desired characteristic impedance, thereby bringing about advantages similar to those of the nineteenth embodiment.

Figure 47:
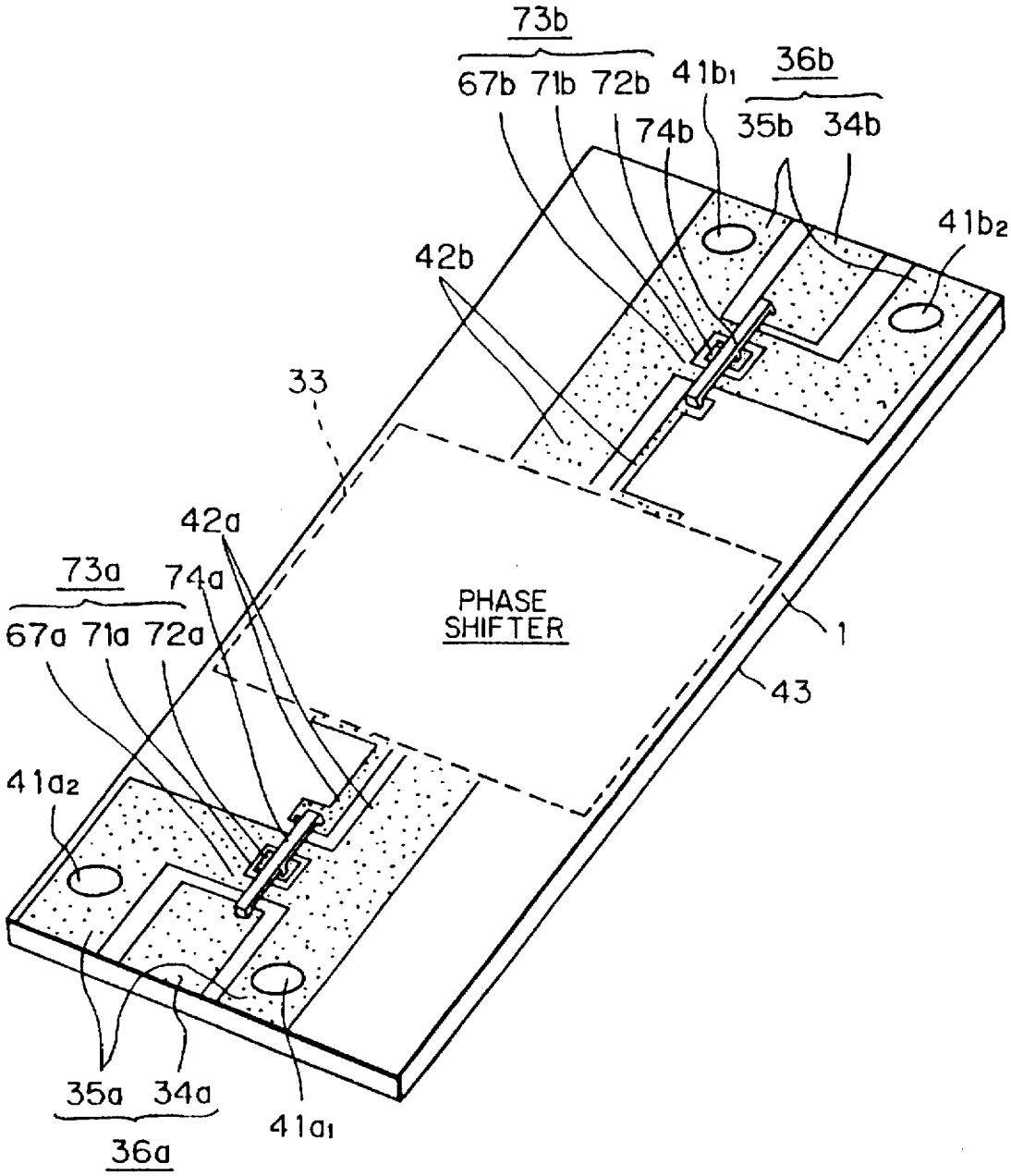
FIG. 47 illustrates a schematic view of the structure of the twenty-second embodiment of a phase shifter according to the present invention.

FIG. 47 illustrates the structure of the twenty-second embodiment at a phase shifter according to the present invention. In the embodiment illustrated in FIG. 44, microstrip lines 70a and 70b are disposed between input/output coplanar line patterns 36a and 36b and slot line pattern pairs 42a and 42b. If dielectric materials 68a and 68b are as thin as thousands of angstroms, a pattern width of microstrip line patterns 69a and 69b must considerably be narrow in order to obtain a predetermined characteristic impedance (for example, 50Ω), and such a narrow pattern is unachievable. The phase shifter illustrated in FIG. 47 is structured to form small parallel-plate capacitors 73a and 73b by ground patterns 67a and 67b, dielectric materials 71a and 71b and upper electrodes 72a and 72b and to make connections by the air bridges. Therefore, these portions equivalently constitute T-shaped low-pass filters each comprising capacitor 75 and inductors 76a and 76b (FIG. 46) to achieve a desired characteristics impedance, thereby bringing about advantages similar to those of the twentieth embodiment.

Figure 48:
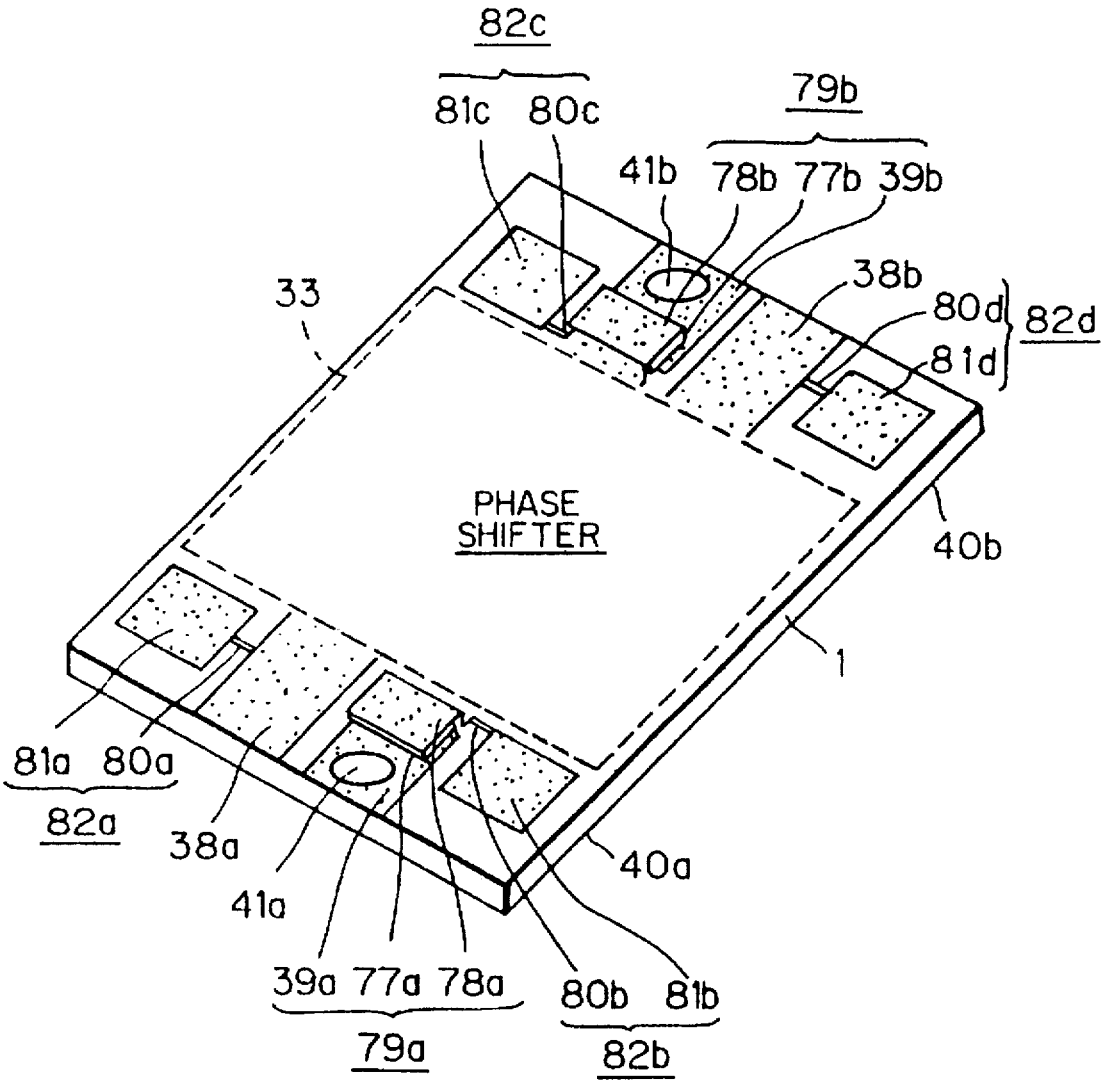
FIG. 48 illustrates a schematic view of the structure of the twenty-third embodiment of a phase shifter according to the present invention.

FIG. 48 illustrates the structure of the twenty-third embodiment of a phase shifter according to the present invention. In the figure, the reference numerals 77a and 77b define dielectric materials; 78a and 78b, upper electrodes formed on the upper surfaces of dielectric materials 77a and 77b; 77a and 77b parallel-plate capacitors formed by ground patterns 39a and 39b, dielectric materials 77a and 77b and upper electrodes 78a and 78b; 80a to 80d bias resistances; 81a to 81d bias pads; and 82a to 82d bias circuits comprising bias resistances 80a to 80d and bias pads 81a to 81d. Upper electrodes 78a and 78b are connected, as illustrated in the figure, to any one of input/output slot line patterns 2a and 2b. If a positive voltage AV (A>|pinch-off voltage|) is applied to bias pads 81a to 81d, drain voltages and source voltages of first to fourth FETs 6a to 6d become positive. Therefore, each of the FETs performs a switching operation to pass and cut off a microwave signal by switching the gate voltage between 0 V and AV. Since the gate voltage can thus be controlled in a positive voltage range, control, for example, in a TTL become possible. In addition, the phase shifter and an external drive circuit can be considerably reduced in size.

In the second to twenty-third embodiments, an FET or a diode is used as a switching element, but a transistor such as bipolar transistor, high electron mobility transistor (HEMT) and heterojunction bipolar transistor (HBT) may be used in accordance with such requirements as switching speed and electrical power resistance.

What is claimed is:

1. A phase shifter comprising a first input/output line pair first to fourth switches and a second input/output line pair; wherein one of said first input/output lines is connected to one end of said, first switch and to one end of said fourth switch, the other of said first input/output lines is connected to one end of said second switch and to one end of said third switch, one of said second input/output lines is connected to the other end of said first switch and to the other end of said third switch, and the other of said second input/output lines is connected to the other end of said second switch and to the other end of said fourth switch, said phase shifter further comprising an air bridge that connects said one of said second input/output lines to said other end of said third switch.

2. A phase shifter comprising a semiconductor substrate, a first slot line pattern pair formed on said semiconductor substrate, a second slot line pattern pair formed on said semiconductor substrate so as to align with said first slot line pattern pair, and first to fourth FETs each having a gate; wherein one of said first slot line patterns is connected to the drain electrode of said first FET and to the source electrode of said fourth FET, the other of said first slot line patterns is connected to the drain electrode of said second FET and to the source electrode of said third FET, one of said second slot line patterns is connected to the drain electrode of said third FET, the other of said second slot line patterns is connected to the drain electrode of said fourth FET, the source electrode of said first FET is connected to the drain electrode of said third FET and the source electrode of said second FET is connected to the drain electrode of said fourth FET.

3. A phase shifter according to claim 2 wherein the source electrode of said first FET is used as the drain electrode of said third FET and is connected to one of said second slot line patterns, the source electrode of said second FET is used as the drain electrode of said fourth FET and is connected to the other of said second slot line patterns, the drain electrode of said first FET and the source electrode of said fourth FET are interconnected by an air bridge, the source electrode of said third FET and the drain electrode of said second FET are interconnected by an air bridge and said first to fourth FETs are arranged in the shape of a ladder in the direction perpendicular to said first and second slot line pattern pairs.

4. A phase shifter according to claim 2 further comprising:

a first coplanar line pattern having a signal line pattern and a return pattern pair;

a second coplanar line pattern having a signal line pattern and a return pattern pair;

a ground pattern formed on the surface of said semiconductor substrate opposite to said first coplanar line pattern and connected, through a via hole, to the return pattern pair of said first coplanar line pattern; and a ground pattern formed on the surface of said semiconductor substrate opposite to said second coplanar line pattern and connected, through a via hole, to the return pattern pair of said second coplanar line pattern.

5. A phase shifter according to claim 2 further comprising (a) a first coplanar line pattern having a signal line pattern and a return pattern pair connected through an air bridge, and (b) a second coplanar line pattern having a signal line pattern and a return pattern pair connected through an air bridge; wherein one of the return patterns of said first coplanar line pattern is connected to one of said first slot line patterns, the signal line pattern of said first coplanar line pattern is connected to the other of said slot line patterns, one of the return patterns of said second coplanar line pattern is connected to one of said second slot line patterns and the signal line pattern of said second coplanar line pattern is connected to the other of said second slot lien patterns.

6. A phase shifter according to claim 5, further comprising a third slot line pattern pair formed between said first slot line pattern pair and said first coplanar line pattern, a fourth slot line pattern pair formed between said second slot line pattern pair and said second coplanar line pattern, and a ground pattern formed on the entire bottom surface of said semiconductor substrate; wherein one of said first slot line patterns is connected to the signal line pattern of said first coplanar line pattern through one of said third slot line patterns, the other of said first slot line patterns is connected to one of the return patterns of said first coplanar line pattern through the other of said third slot line patterns, one of said third slot line patterns is formed narrower than the other so that a characteristic impedance of said first slot line pattern pair is smaller than a characteristic impedance of a microstrip line formed by one of said third slot line patterns and said ground pattern, one of said second slot line patterns is connected to the signal line pattern of said second coplanar line pattern through said fourth slot line pattern pair, the other of said second slot line patterns is connected to one of the return patterns of said second coplanar line pattern through said second slot line pattern pair, and one of said fourth slot line patterns is formed narrower than the other so that a characteristic impedance of said second slot line pattern pair is smaller than a characteristic impedance of a microstrip line formed by one of said fourth slot line patterns and said ground pattern.

7. A phase shifter according to claim 6, wherein the microstrip line formed of one of said third slot line patterns and said ground pattern and the microstrip line formed of one of said fourth slot line patterns and said ground pattern respectively have a length substantially equal to a quarter of the wavelength of an operating frequency.

8. A phase shifter according to claim 6, wherein a first capacitor one end of which is connected to said ground pattern through a via hole is connected to a junction point of the signal line pattern of said coplanar line pattern and said third slot line pattern pair, and a second capacitor one end of which is connected to said ground pattern through a via hole is connected to a junction point of the signal line pattern of said second coplanar line pattern and said fourth slot line pattern pair.

9. A phase shifter according to claim 6, further comprising (a) a microstrip line comprising a first ground pattern formed between said third slot line pattern pair and said first coplanar line pattern, a first dielectric material provided on said first ground pattern and a first microstrip line pattern formed on said first dielectric material, and (b) a microstrip line comprising a second ground pattern formed between said fourth slot line pattern pair and said second coplanar line pattern, a second dielectric material provided on said second ground pattern and a second microstrip line pattern formed on said second dielectric material; wherein the signal line pattern of said first coplanar line pattern is connected to the narrower pattern of said third slot line patterns through said first microstrip line pattern, said first ground pattern is connected to the other of said third slot line patterns and thereby to any one of the return patterns of said first coplanar line pattern, the signal line pattern of said second coplanar line pattern is connected to the narrower pattern of said fourth slot line patterns through said microstrip line pattern, and said second ground pattern is connected to the other of said fourth slot line patterns and thereby to any one of the return patterns of said second coplanar line pattern.

10. A phase shifter according to claim 6, further comprising (a) a first parallel-plate capacitor having electrodes and formed between the narrower pattern of said third slot line patterns and said first coplanar line pattern, and (b) a second parallel-plate capacitor having electrodes and formed between the narrower pattern of said fourth slot line patterns and second coplanar line pattern; wherein one of the electrodes of said first parallel-plate capacitor is connected to the signal line pattern of said first coplanar line pattern and the narrower pattern of said third slot line patterns, the other of the electrodes of said first parallel-plate capacitor is connected to the other of said third slot line pattern and thereby to one of the return patterns of said first coplanar line pattern, one of the electrodes of said second parallel-plate capacitor is connected to the signal line pattern of said second coplanar line pattern and the narrower pattern of said fourth slot line patterns, and the other of the electrode of said second parallel-plate capacitor is connected to the other of said fourth slot line patterns and thereby to any one of the return patterns of said second coplanar line pattern.

11. A phase shifter according to claim 6, wherein said ground pattern is connected to said via hole through a capacitor.

12. A phase shifter according to claim 2, further comprising a (a) first microstrip line pattern having a signal line pattern formed on one surface of the semiconductor substrate and a ground pattern formed on the other surface of said semiconductor substrate, and (b) a second microstrip line pattern having a signal line pattern formed on one surface of said semiconductor substrate and a ground pattern formed on the other surface of said semiconductor substrate; wherein one of said first slot line patterns is connected to the signal line pattern of said first microstrip line pattern, the other of said first slot line patterns is the connected to the ground pattern of said first microstrip line pattern through a via hole, one of said second slot line patterns is connected to the signal pattern of said second microstrip line pattern and the other of said second slot line patterns is connected to the ground pattern of said second microstrip line pattern through a via hole.

13. A phase shifter according to claim 12, further comprising a third slot line pattern pair formed between said first slot line pattern pair and said first microstrip line pattern, a fourth slot line pattern pair formed between-said second slot line pattern pair and said second microstrip line pattern, and a ground pattern formed on the entire bottom surface of said semiconductor substrate; wherein one of said first slot line patterns is connected to the signal line pattern of said first microstrip line pattern through said third slot line pattern pair, the other of said first slot line patterns is connected to the other of said third slot line patterns, the other of said third slot line patterns is connected to said ground pattern through a via hole, one of said third slot line patterns is formed narrower than the other so that a characteristic impedance of said first slot line pattern pair is smaller than a characteristic impedance of a microstrip line comprising one of said third slot line patterns and said ground pattern, one of said second slot line patterns is connected to the signal line pattern of said microstrip line pattern through one of said fourth slot line patterns, the other of said second slot line patterns is connected to the other of said fourth slot line patterns, the other of said fourth slot line patterns is connected to said ground pattern through a via hole, and one of said fourth slot line patterns is formed narrower than the other so that a characteristic impedance of said second slot line pattern pair is smaller than a characteristic impedance of a microstrip line comprising one of said fourth slot line patterns and said ground pattern.

14. A phase shifter according to claim 13, further comprising a first capacitor having one end connected to said ground pattern through a via hole and another end connected to a junction point of said first microstrip line pattern and said third slot line pattern pair and a second capacitor having one end connected to said ground pattern through a via hole and another end connected to a junction point of said second microstrip line pattern and said fourth slot line pattern pair.

15. A phase shifter according to claim 14, wherein the drain electrode of a fifth FET is connected to said first capacitor, the source electrode of said fifth FET is connected to said ground pattern through a via hole, an inductor is loaded between the drain and source electrodes of said fifth FET, the drain electrode of a sixth FET is connected to said second capacitor, the source electrode of said sixth FET is connected to said ground pattern through a via hole and an inductor is loaded between the drain and source electrodes of said sixth FET.

16. A phase shifter according to claim 13, further comprising (a) a microstrip line comprising a first ground pattern formed between said third slot line pattern pair and said first microstrip line pattern, a first dielectric material provided on said first ground pattern and a first microstrip line pattern formed on said first dielectric material, and (b) a microstrip line comprising a second ground pattern formed between said fourth slot line pattern pair and said second microstrip line pattern, a second dielectric material provided on said second ground pattern and a second microstrip line pattern formed on said second dielectric material; wherein said first microstrip line pattern is connected to the narrower pattern of said third slot line patterns through said first microstrip line pattern, said first ground pattern is connected to the other of said third slot line patterns and thereby connected through a via hole to said ground pattern formed on the entire bottom surface of the substrate, said second microstrip lien pattern is connected to the narrower pattern of said fourth slot line patterns through said second microstrip line pattern, and said second ground pattern is connected to the other of said fourth slot line patterns and thereby connected through a via hole to said bottom surface ground pattern.

17. A phase shifter according to claim 13, further comprising (a) a first parallel-plate capacitor having electrodes and formed between the narrower pattern of said third slot line patterns and said microstrip line pattern, and (b) a second parallel-plate capacitor having electrodes and formed between the narrower pattern of said fourth slot line patterns and said second microstrip line pattern; wherein one of the electrodes of said first parallel-plate capacitor is connected to said first microstrip line pattern and the narrower pattern of said third slot line patterns, the other of the electrodes of said first parallel-plate capacitor is connected to the other of said third slot line patterns, one of the electrodes of said second parallel-plate capacitor is connected to said second microstrip line pattern and the narrower pattern of said fourth slot line patterns and the other of the electrodes of said second parallel-plate capacitor is connected to the other of said fourth slot line patterns.

18. The phase shifter of claim 2, wherein the gate of each of the first to fourth FETs is formed in a direction parallel to said first and second slot line pattern pairs.

19. The phase shifter of claim 2, wherein the gate of each of the first to fourth FETs is formed in a direction perpendicular to said first and second slot line pattern pairs.

20. The phase shifter of claim 2, further comprising:

a first bias circuit operatively coupled to the gate of each of the first and second FETs; and a second bias circuit operatively coupled to the gate of each of the third and fourth FETs.

21. The phase shifter of claim 2, wherein each of the first, second, third, and fourth FETS includes a respective plurality of FETs connected together in parallel.

22. A phase shifter comprising a semiconductor substrate, a first slot line pattern pair formed on said semiconductor substrate, a second slot line pattern pair formed on said semiconductor substrate so as to align with said first slot line pattern pair, and first to fourth diodes; wherein one of said first slot line patterns is connected to the cathode electrode of said first diode and to the anode electrode of said fourth diode, the other of said first slot line patterns is connected to the cathode electrode of said second diode and to the anode electrode of said third diode, one of said second slot line patterns is connected to the cathode electrode of said third diode, the other of said second slot line patterns is connected to the cathode electrode of said fourth diode, the anode electrode of said first diode is connected to the cathode electrode of said third diode and the anode electrode of said second diode is connected to the cathode electrode of said fourth diode.

23. A phase shifter according to claim 22, further comprising (a) a first coplanar line pattern having a signal line pattern and a return pattern pair connected through an air bridge, and (b) a second coplanar line pattern having a signal line pattern and a return pattern pair connected through an air bridge; wherein one of the return patterns of said first coplanar line pattern is connected to one of said first slot line patterns, the signal line pattern of said first coplanar line pattern is connected to the other of said first slot line patterns, one of the return patterns of said second coplanar line pattern is connected to one of said second slot line patterns, and the signal line pattern of said second coplanar line pattern is connected to the other of said second slot line patterns.

24. A phase shifter according to claim 23, further comprising (a) a ground pattern formed on a surface of said semiconductor substrate opposite to said first coplanar line pattern and connected to the return pattern pair of said coplanar line pattern through via holes and (b) a ground pattern formed on said surface of said semiconductor substrate opposite to said second coplanar line pattern and connected to the return pattern pair of said coplanar line pattern through via holes.

25. A phase shifter according to claim 24, further comprising a third slot line pattern pair formed between said first slot line pattern pair and said first coplanar line pattern, a fourth slot line pattern pair formed between said second slot line pattern pair and said second coplanar line pattern, and a ground pattern formed on the entire part of the rear surface of said semiconductor substrate; wherein one of said first slot line patterns is connected to the signal line pattern of said first coplanar line pattern through one of said third slot line pattern pair, the other of said first slot line patterns is connected to one of the return patterns of said first coplanar line pattern through the other of said third slot line patterns, one of said third slot line patterns is formed narrower than the other so that a characteristic impedance of said first slot line pattern pair is smaller than a characteristic impedance of a microstrip line comprising one of said third slot line patterns and said ground pattern, one of said second slot line patterns is connected to the signal line pattern of said second coplanar line pattern through said fourth slot line pattern pair, the other of said second slot line patterns is connected to one of the return patterns of said coplanar line pattern through the other of said fourth slot line patterns, and one of said fourth slot line patterns is formed narrower than the other so that a characteristic impedance of said second slot line pattern pair is smaller than a characteristic impedance of a microstrip line comprising one of said fourth slot line patterns and said ground pattern.

26. A phase shifter according to claim 25, wherein said ground pattern is connected to said via hole through a capacitor.

27. A phase shifter according to claim 25, wherein the microstrip line comprising one of said third slot line patterns and said ground pattern and the microstrip line comprising one of said fourth slot line patterns and said ground pattern respectively have a length substantially equal to a quarter of the wavelength of an operating frequency.

28. A phase shifter according to claim 25, wherein a first capacitor one end of which is connected to said ground pattern through a via hole is connected to a junction point of the signal line pattern of said coplanar line pattern and said third slot line pattern pair and a second capacitor one end of which is connected to said ground pattern through a via hole is connected to a junction point of the signal line pattern of said second coplanar line pattern and said fourth slot line pattern pair.

29. A phase shifter according to claim 25, wherein a first capacitor one end of which is connected to said ground pattern is connected through a via hole to a junction point of said first microstrip line pattern and said third slot line pattern pair, and a second capacitor one end of which is connected to said ground pattern is connected through a via hole to a junction point of said second microstrip line pattern and said fourth slot line pattern pair.

30. A phase shifter according to claim 25, further comprising (a) a microstrip line comprising a first ground pattern formed between said third slot line pattern pair and said first coplanar line pattern, a first dielectric material provided on said first ground pattern and a first microstrip line pattern formed on said first dielectric material, and (b) a microstrip line comprising a second ground pattern formed between said fourth slot line pattern pair and said second coplanar line pattern, a second dielectric material provided on said second ground pattern and a second microstrip line pattern formed on said second dielectric material; wherein the signal line pattern of said first coplanar line pattern is connected to the narrower pattern of said third slot line patterns through said first microstrip line pattern, said first ground pattern is connected to the other of said third slot line patterns and thereby to any one of the return patterns of said first coplanar line pattern, the signal line pattern of said coplanar line pattern is connected to the narrower pattern of said fourth slot line patterns, and said second ground pattern is connected to the other of said fourth slot line patterns and thereby to any one of the return patterns of said second coplanar line pattern.

31. A phase shifter according to claim 25, further comprising (a) a parallel-plate capacitor having electrodes and formed between the narrower pattern of said third slot line patterns and said first coplanar line pattern, and (b) a second parallel-plate capacitor having electrodes and formed between the narrower pattern of said fourth slot line patterns and said second coplanar line pattern; wherein one of the electrodes of said first parallel-plate capacitor is connected to the signal line pattern of said first coplanar line pattern and the narrower pattern of said third slot line patterns, the other of the electrodes of said first parallel-plate capacitor is connected to the other of said third slot line patterns and thereby to one of the return patterns of said first coplanar line pattern, one of the electrode of said second parallel-plate capacitor is connected to the signal line pattern of said second coplanar line pattern and the narrower pattern of said fourth slot line patterns, and the other of the electrodes of said second parallel-plate capacitor is connected to the other of said fourth slot line patterns and thereby to one of the return patterns of said second coplanar line pattern.

32. A phase shifter according to claim 22, further comprising (a) a first microstrip line pattern having a signal line pattern formed on one surface of said semiconductor substrate and a ground pattern formed on the other surface of said semiconductor substrate, and (b) a second microstrip line pattern having a signal line pattern formed on one surface of said semiconductor substrate and a ground pattern formed on the other surface of said semiconductor substrate; wherein one of said first slot line patterns is connected to the signal line pattern of said first microstrip line pattern, the other of said first slot line patterns is connected to the ground pattern of said first microstrip line pattern through a via hole, one of said second slot line patterns is connected to the signal line pattern of said second microstrip line pattern, and the other of said second slot line patterns is connected to the ground pattern of said second microstrip line pattern through a via hole.

33. A phase shifter according to claim 32, further comprising (a) a third slot line pattern pair formed between said first slot line pattern pair and said first microstrip line pattern, (b) a fourth slot line pattern pair formed between said second slot line pattern pair and said second microstrip line pattern, and (c) a ground pattern formed on the entire bottom surface of said semiconductor substrate; wherein one of said first slot line patterns is connected to the signal line pattern of said first microstrip line pattern through one of said third slot line patterns, the other of said first slot line patterns is connected to the other of said third slot line patterns, the other of said third slot line patterns is connected to said ground pattern through a via hole, one of said third slot line patterns is formed narrower than the other so that a characteristic impedance of said first slot line pattern pair is smaller than a characteristic impedance of a microstrip line comprising one of said third slot line patterns and said ground pattern, one of said second slot line patterns is connected to the signal line pattern of said second microstrip line pattern through one of said fourth slot line patterns, the other pattern of said second slot line patterns is connected to the other of said fourth slot line patterns, the other of said fourth slot line patterns is connected to said ground pattern through a via hole, and one of said fourth slot line patterns is formed narrower than the other so that a characteristic impedance of said second slot line pattern pair is smaller than a characteristic impedance of a microstrip line comprising one of said fourth slot line patterns and said ground pattern.

34. A phase shifter according to claim 33, wherein the anode electrode of a fifth diode is connected to said first capacitor, the cathode electrode of said fifth diode is connected to said ground pattern through a via hole, the anode electrode of a sixth diode is connected to said second capacitor, and the cathode electrode of said sixth diode is connected to said ground pattern through a via hole.

35. A phase shifter according to claim 33, further comprising (a) a microstrip line comprising a first ground pattern formed between said third slot line pattern pair and said first microstrip line pattern, a first dielectric material provided on said ground pattern and a third microstrip line pattern formed on said first dielectric material, and (b) a microstrip line comprising a second ground pattern formed between said fourth slot line pattern pair and said second microstrip line pattern, a second dielectric material provided on said second ground pattern and a fourth microstrip line pattern formed on said second dielectric material; wherein said first microstrip line pattern is connected to the narrower pattern of said third slot line patterns through said first microstrip line pattern, said first ground pattern is connected to the other of said third slot line patterns and thereby to said ground pattern through a via hole, said second microstrip line pattern is connected to the narrower pattern of said fourth slot line patterns through said second microstrip line pattern, and said second ground pattern is connected to the other of said fourth slot line patterns and thereby to said ground pattern through a via hole.

36. A phase shifter according to claim 33, further comprising (a) a first parallel-plate capacitor formed between the narrower pattern of said third slot line patterns and said first microstrip line pattern, and (b) a second parallel-plate capacitor formed between the narrower pattern of said fourth slot line patterns and said second microstrip line pattern; wherein one of the electrodes of said first parallel-plate capacitor is connected to said first microstrip line pattern and the narrower pattern of said third slot line patterns, the other of the electrodes of said first parallel-plate capacitor is connected to the other of said third slot line patterns, one of the electrodes of said second parallel-plate capacitor is connected to said second microstrip line pattern and the narrower pattern of said fourth slot line patterns, and the other of the electrodes of said second parallel-plate capacitor is connected to the other of said fourth slot line patterns.

37. A phase shifter comprising a first input/output line pair, first to fourth switches and a second input/output line pair; wherein one of said first input/output lines is connected to one end of said first switch and to one end of said fourth switch, the other of said first input/output lines is connected to one end of said second switch and to one end of said third switch, one of said second input/output lines is connected to the other end of said first switch and to the other end of said third switch, and the other of said second input/output lines is connected to the other end of said second switch and to the other end of said fourth switch, wherein each of the first to fourth switches includes a FET having a gate, source, and drain, each gate, source and drain being arranged in a direction perpendicular to a direction from the first input/output line pair to the second input/output line pair.

38. A phase shifter comprising a first input/output line pair, first to fourth switches and a second input/output line pair; wherein one of said first input/output lines is connected to one end of said first switch and to one end of said fourth switch, the other of said first input/output lines is connected to one end of said second switch and to one end of said third switch, one of said second input/output lines is connected to the other end of said first switch and to the other end of said third switch, and the other of said second input/output lines is connected to the other end of said second switch and to the other end of said fourth switch, wherein each of the first to fourth switches includes a FET having a gate, source, and drain, each gate, source and drain being arranged in a direction parallel to a direction from the first input/output line pair to the second input/output line pair.

* * * * *